US010289072B2

(12) United States Patent
Hasegawa

(10) Patent No.: US 10,289,072 B2
(45) Date of Patent: May 14, 2019

(54) ELECTRONIC TIMEPIECE AND SETTING DISPLAY METHOD

(71) Applicant: CASIO COMPUTER CO., LTD., Shibuya-ku, Tokyo (JP)

(72) Inventor: Kosuke Hasegawa, Koganei (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 32 days.

(21) Appl. No.: 15/465,182

(22) Filed: Mar. 21, 2017

(65) Prior Publication Data

US 2017/0364030 A1 Dec. 21, 2017

(30) Foreign Application Priority Data

Jun. 17, 2016 (JP) ..... 2016-120544

(51) Int. Cl.

| | |
|---|---|
| ***G04G 9/00*** | (2006.01) |
| ***G04B 19/22*** | (2006.01) |
| ***G04R 20/02*** | (2013.01) |
| ***G04B 19/23*** | (2006.01) |

(52) U.S. Cl.

CPC ..... *G04B 19/235* (2013.01); *G04B 19/22* (2013.01); *G04B 19/223* (2013.01); *G04G 9/0076* (2013.01); *G04R 20/02* (2013.01)

(58) Field of Classification Search

CPC .... G04B 19/22; G04B 19/223; G04B 19/225; G04G 9/0076

See application file for complete search history.

(56) References Cited

U.S. PATENT DOCUMENTS

| | | | | |
|---|---|---|---|---|
| 1,889,393 | A * | 11/1932 | Wilson | G04B 19/223 368/27 |
| 2005/0105397 | A1* | 5/2005 | Tuason | G04B 19/262 368/21 |
| 2006/0171256 | A1* | 8/2006 | Herbert | G04C 17/0058 368/21 |
| 2008/0031095 | A1* | 2/2008 | Matsuzaki | G01S 19/14 368/14 |
| 2013/0322218 | A1* | 12/2013 | Burkhardt | G04C 3/146 368/22 |
| 2015/0146503 | A1* | 5/2015 | Nakanishi | G04R 20/02 368/21 |

FOREIGN PATENT DOCUMENTS

JP 2006266987 A 10/2006

* cited by examiner

*Primary Examiner* — Daniel P Wicklund
(74) *Attorney, Agent, or Firm* — Holtz, Holtz & Volek PC

(57) ABSTRACT

An electronic timepiece includes: a bezel having location markers for indicating positions of the world; a second hand moving relative to the bezel; a memory storing time difference information in which each location marker is associated with information relating to a time zone to which a position indicated by each location marker belongs; and a controller performing operation control for moving the second hand relative to the bezel, and the bezel has a set exception indication position representing non-correspondence to any time zone associated with each location marker by being in a predetermined positional relationship with the second hand, and the controller causes the second hand and the exception indication position to be in the predetermined positional relationship when there is no location marker associated with a set time zone, during display relating to the set time zone for a date and time to be displayed.

20 Claims, 15 Drawing Sheets

FIG. 3A

42b

| ID | CITY NAME | MARKER POSITION | TIME DIFFERENCE | DAYLIGHT SAVING TIME IMPLEMENTATION |
|---|---|---|---|---|
| 00 | UTC | 0 | +0:00 | 0 |
| 01 | LON | 2 | +0:00 | 1 |
| 02 | PAR | 4 | +1:00 | 1 |
| 03 | ATH | 6 | +2:00 | 1 |
| 12 | [illegible] | 24 | +7:00 | 0 |
| 13 | HKG | 26 | +8:00 | 0 |
| 14 | TYO | 28 | +9:00 | 0 |
| 15 | ADL | 30 | +9:30 | 4 |
| | | | | |

FIG. 3B

42c

| ID | CITY NAME | MARKER POSITION | TIME DIFFERENCE | DAYLIGHT SAVING TIME IMPLEMENTATION |
|---|---|---|---|---|
| 00 | UTC | 0 | +0:00 | 0 |
| 01 | LON | 2 | +0:00 | 1 |
| 02 | PAR | 4 | +1:00 | 1 |
| 03 | ATH | 6 | +2:00 | 1 |
| 12 | [illegible] | 24 | +7:00 | 0 |
| 13 | HKG | 26 | +8:00 | 0 |
| 14 | TYO | 28 | +8:00 | 0 |
| 15 | ADL | 30 | +9:30 | 4 |
| | | | | |

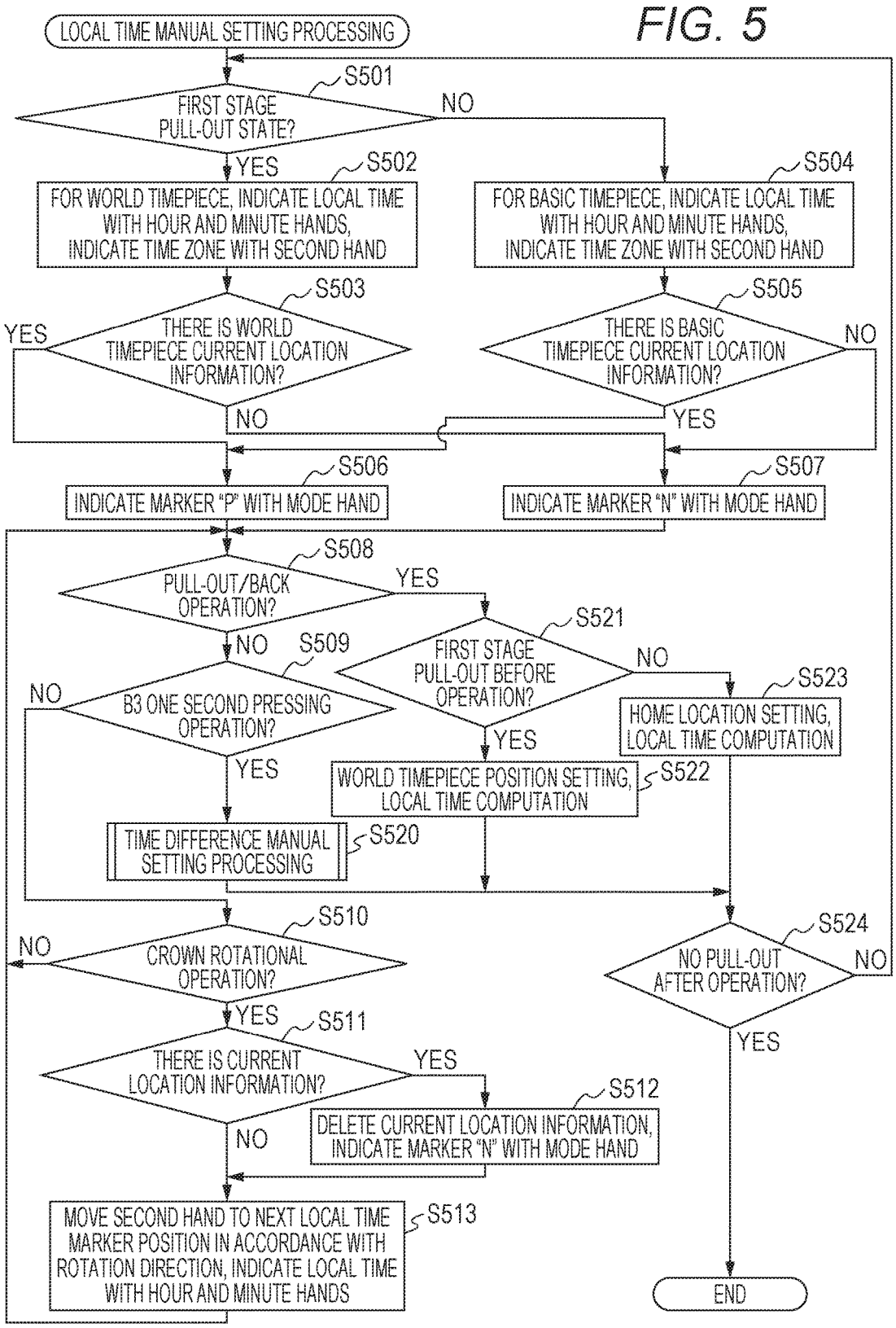
FIG. 5
LOCAL TIME MANUAL SETTING PROCESSING
S501
FIRST STAGE PULL-OUT STATE?
NO
YES
S502
FOR WORLD TIMEPIECE, INDICATE LOCAL TIME WITH HOUR AND MINUTE HANDS, INDICATE TIME ZONE WITH SECOND HAND
S504
FOR BASIC TIMEPIECE, INDICATE LOCAL TIME WITH HOUR AND MINUTE HANDS, INDICATE TIME ZONE WITH SECOND HAND
S503
THERE IS WORLD TIMEPIECE CURRENT LOCATION INFORMATION?
YES
NO
S505
THERE IS BASIC TIMEPIECE CURRENT LOCATION INFORMATION?
NO
YES
S506
INDICATE MARKER "P" WITH MODE HAND
S507
INDICATE MARKER "N" WITH MODE HAND
S508
PULL-OUT/BACK OPERATION?
YES
NO
S521
FIRST STAGE PULL-OUT BEFORE OPERATION?
NO
YES
S509
B3 ONE SECOND PRESSING OPERATION?
NO
YES
S523
HOME LOCATION SETTING, LOCAL TIME COMPUTATION
WORLD TIMEPIECE POSITION SETTING, LOCAL TIME COMPUTATION
S522
TIME DIFFERENCE MANUAL SETTING PROCESSING
S520
S510
CROWN ROTATIONAL OPERATION?
NO
YES
S524
NO PULL-OUT AFTER OPERATION?
NO
YES
S511
THERE IS CURRENT LOCATION INFORMATION?
YES
NO
S512
DELETE CURRENT LOCATION INFORMATION, INDICATE MARKER "N" WITH MODE HAND
MOVE SECOND HAND TO NEXT LOCAL TIME MARKER POSITION IN ACCORDANCE WITH ROTATION DIRECTION, INDICATE LOCAL TIME WITH HOUR AND MINUTE HANDS
S513
END

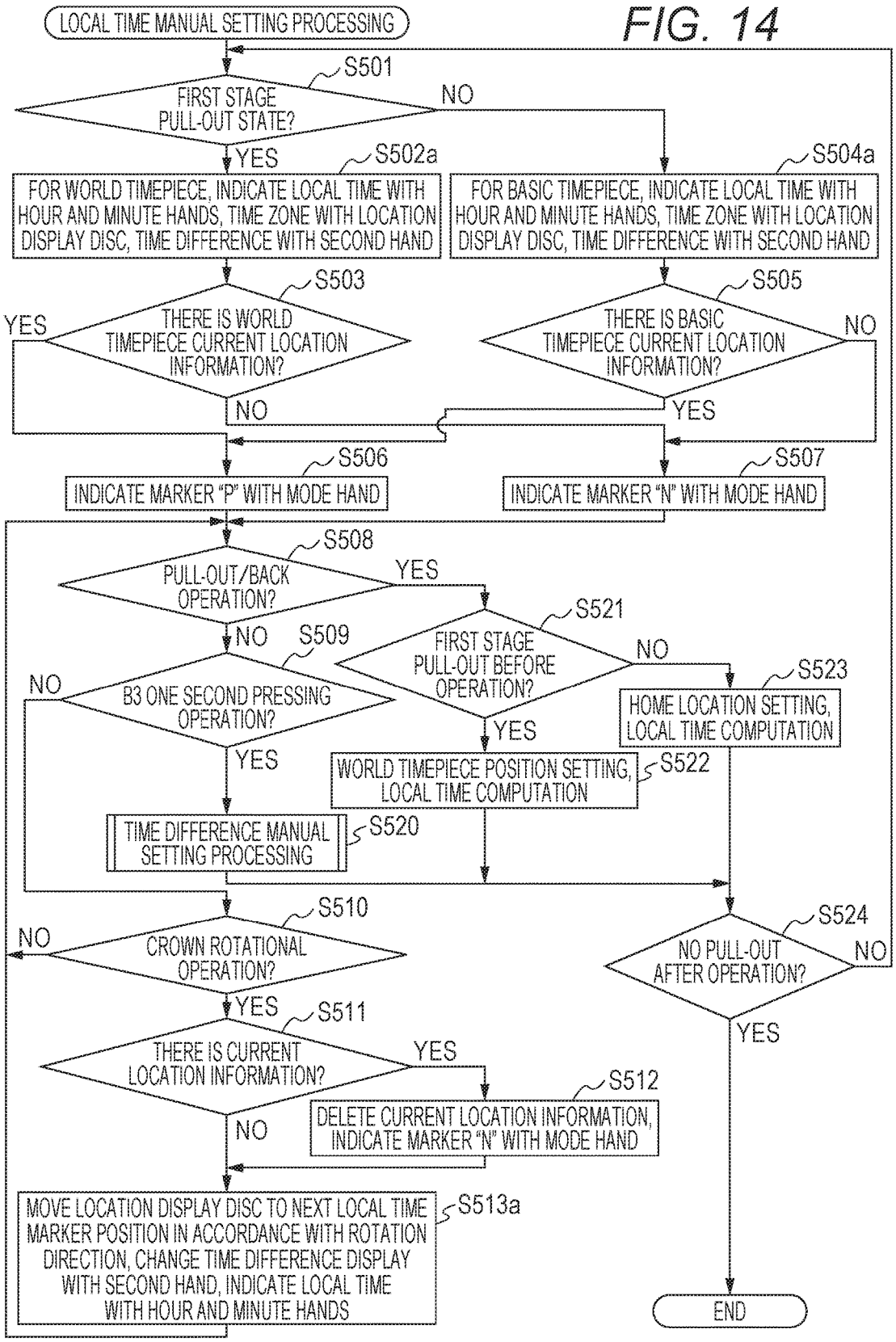
FIG. 14
LOCAL TIME MANUAL SETTING PROCESSING
S501
FIRST STAGE PULL-OUT STATE?
NO
YES
S502a
FOR WORLD TIMEPIECE, INDICATE LOCAL TIME WITH HOUR AND MINUTE HANDS, TIME ZONE WITH LOCATION DISPLAY DISC, TIME DIFFERENCE WITH SECOND HAND
S504a
FOR BASIC TIMEPIECE, INDICATE LOCAL TIME WITH HOUR AND MINUTE HANDS, TIME ZONE WITH LOCATION DISPLAY DISC, TIME DIFFERENCE WITH SECOND HAND
S503
THERE IS WORLD TIMEPIECE CURRENT LOCATION INFORMATION?
YES
NO
S505
THERE IS BASIC TIMEPIECE CURRENT LOCATION INFORMATION?
NO
YES
S506
INDICATE MARKER "P" WITH MODE HAND
S507
INDICATE MARKER "N" WITH MODE HAND
S508
PULL-OUT/BACK OPERATION?
YES
NO
S521
FIRST STAGE PULL-OUT BEFORE OPERATION?
NO
YES
S523
HOME LOCATION SETTING, LOCAL TIME COMPUTATION
S509
B3 ONE SECOND PRESSING OPERATION?
NO
YES
WORLD TIMEPIECE POSITION SETTING, LOCAL TIME COMPUTATION
S522
TIME DIFFERENCE MANUAL SETTING PROCESSING
S520
S510
CROWN ROTATIONAL OPERATION?
NO
YES
S524
NO PULL-OUT AFTER OPERATION?
NO
YES
S511
THERE IS CURRENT LOCATION INFORMATION?
YES
NO
S512
DELETE CURRENT LOCATION INFORMATION, INDICATE MARKER "N" WITH MODE HAND
MOVE LOCATION DISPLAY DISC TO NEXT LOCAL TIME MARKER POSITION IN ACCORDANCE WITH ROTATION DIRECTION, CHANGE TIME DIFFERENCE DISPLAY WITH SECOND HAND, INDICATE LOCAL TIME WITH HOUR AND MINUTE HANDS
S513a
END

ELECTRONIC TIMEPIECE AND SETTING DISPLAY METHOD

BACKGROUND OF THE INVENTION

The invention relates to an electronic timepiece and a display method.

Conventionally, there is an electronic timepiece capable of computing and/or setting locations in various places of the world and displaying the date and time (local time) at the location. This electronic timepiece holds in advance setting information of each time zone of the world and information relating to a daylight saving time implementation rule, computes a deviation from a reference time such as a coordinated universal time (UTC) depending on the time zone to which the computed/set location belongs and the daylight saving time implementation rule, and displays the current local time.

In an analog type electronic timepiece that displays time by using a hand, markers are provided in advance for indicating a name of a city and time zone information near the periphery of the dial or on the edge of the case (watch bezel) in order to perform setting of the location information and display of the location set, and the markers are indicated by a predetermined hand, whereby setting of the location is performed and the set location is indicated (for example, JP 2006-266987 A).

However, there are many time zones that are used in various places of the world, and the time zones to which the places belong are often changed. Therefore, there is a problem that providing a marker or a scale so as to cover all time zones that can be set on in particular a small electronic timepiece limits design diversity and extensibility.

SUMMARY OF THE INVENTION

An object of the invention is to provide an electronic timepiece and a display method capable of performing time zone display flexibly and appropriately.

To achieve the above object, the present invention is an electronic timepiece including:

an indicator on which a plurality of location markers is provided for indicating locations in various places of the world;

a hand that moves relative to the indicator;

a memory that stores time difference information in which each of the location markers and information relating to a time zone to which a location indicated by each of the location markers belongs are associated with each other; and a controller that performs operation control for moving the hand and the indicator relative to each other, wherein the indicator has an exception indication position representing non-correspondence to any time zone associated with each of the location markers by being in a predetermined positional relationship with the hand, and the controller causes the hand and the exception indication position to be in the predetermined positional relationship when there is not any of the location markers each associated with a set time zone, during display relating to the set time zone for a date and time to be displayed.

BRIEF DESCRIPTION OF THE DRAWINGS

FIG. 3A is a chart illustrating an example of city time difference information and updated city time difference information;

FIG. 3B is a chart illustrating an example of city time difference information and updated city time difference information;

FIG. 5 is a flowchart illustrating a control procedure of local time manual setting processing;

FIG. 14 is a flowchart illustrating a control procedure of local time manual setting processing executed in the electronic timepiece of the second embodiment;

DETAILED DESCRIPTION

Hereinafter, embodiments of the present invention will be described with reference to the drawings.

First Embodiment

Figure 1:
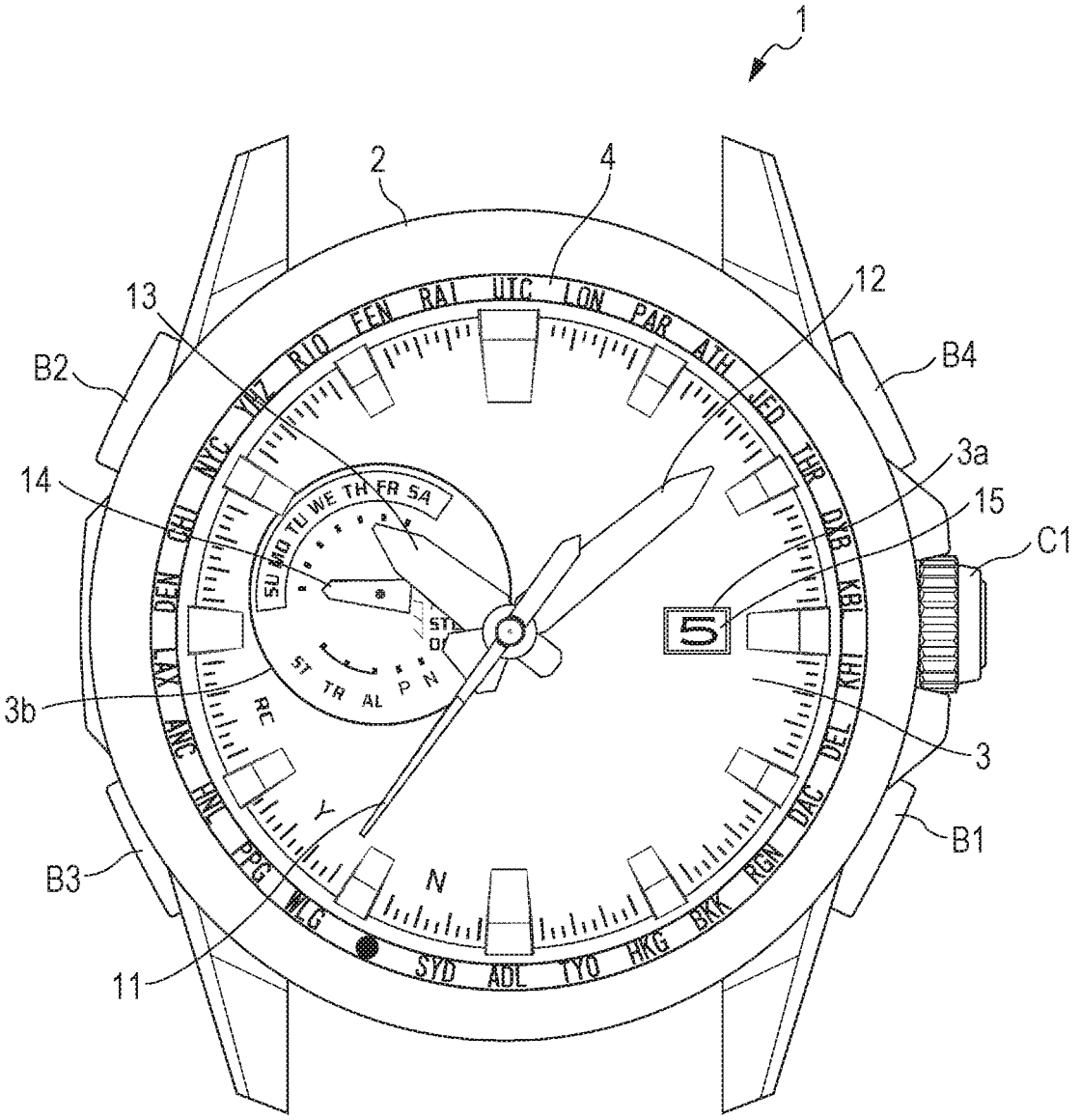
FIG. 1 is a front view illustrating an appearance of an electronic timepiece of a first embodiment of the present invention.

FIG. 1 is a front view illustrating an appearance of an electronic timepiece 1 of a first embodiment of the present invention.

The electronic timepiece 1 includes: a dial 3 provided in a case 2 and a bezel 4 (indicator) provided on the upper front face side peripheral portion of the timepiece; a second hand 11, a minute hand 12, an hour hand 13, and a mode hand 14 provided between the dial 3 and a windshield glass (not illustrated) covering the upper front face side of the timepiece; a date wheel 15 provided in parallel to the dial 3 in the rear face side of the dial 3; and push button switches B1-B4 and a crown C1 provided at the side face of the case 2.

In the following, some or all of the second hand 11, the minute hand 12, the hour hand 13, the mode hand 14, and the date wheel 15 are also collectively referred to as hands 11-15, and the like. In particular, the minute hand 12 and the hour hand 13 are collectively referred to as hour and minute hands 12, 13.

The front face of the dial 3 is provided with markers and scales indicating time circularly near the periphery, and time is displayed by being indicated by the second hand 11, the minute hand 12, and the hour hand 13. In addition to these, the peripheral portion of the dial 3 is provided with markers "Y," "N" and the like. The dial 3 is provided with an opening 3*a* at the three o'clock direction, and markers provided on the date wheel 15 are selectively exposed from the opening 3*a*. The nine o'clock direction of the dial 3 is provided with a small window 3*b*, and the mode hand 14 is provided to be capable of rotation in the small window 3*b*. The peripheral portion of the small window 3*b* is provided with: markers "P," "N;" markers each indicating a day of the week from Sunday to Saturday; sings "ST," "TR," "AL" respectively indicating a stop watch function, a timer function, and an alarm notification function that are function types executable in the electronic timepiece 1; markers relating to a daylight saving time implementation setting; and scales corresponding to the respective markers, and, during normal date and time display, a marker indicating any day of the week is indicated by the mode hand 14.

The markers "P," "N" in the small window 3*b* are markers for respectively indicating whether or not current location information for defining a time zone and a daylight saving time implementation rule is computed by radio wave reception from a positioning satellite and held. Presence/absence of the current location information will be described in details later.

The bezel 4 is circularly provided with local time markers including markers (location markers) indicating abbreviations of names of cities or regions respectively corresponding to a plurality of time zones of the world. When setting of the city or region for which a local date and time (local time) is displayed by using the hands 11-15 and the set time zone is displayed in the electronic timepiece 1, a predetermined hand, here the second hand 11, is caused to rotate (relatively move) and any of these local time markers is indicated (the local time markers of the bezel 4 and the second hand 11 are in a predetermined positional relationship), whereby it is indicated that the electronic timepiece 1 is in a state to be set or has been set in the time zone corresponding to the city or region. The local time markers include a predetermined symbol marker, here a circular marker whose inside is filled, "●" (exception marker, predetermined marker), in addition to the markers indicating the abbreviations of names of cities or regions described above. The bezel 4 is provided with a total of 30 local time markers including the location markers indicating 28 cities or regions, an exception marker provided at a predetermined position (exception indication position) between the 28 location markers, and a reference marker "UTC" indicating a coordinated universal time (UTC), at the same interval, that is, a 2-second interval as a position of the second hand 11 (a 24-minute interval as a position of the hour hand 13). The number of time zones currently set in various places of the world is greater than this; therefore, the bezel 4 is not provided with local time markers indicating cities or regions for all time zones. That is, time zones each having less number of residents and visitors are partially omitted. In addition, currently, the time zone can be set in 15 minute increments; however, there are time zones each having a time difference not set, and those are also omitted.

Incidentally, the bezel 4 may be a frame member integrally formed with the case 2.

The second hand 11, the minute hand 12, the hour hand 13, and the date wheel 15 are provided to be capable of rotation around the same position of an approximate center of the dial 3 as a rotation axis. These hands 11-13, 15 respectively indicate a second, minute, time, and date of a current time in a local time to be displayed during normal date and time display.

Figure 2:
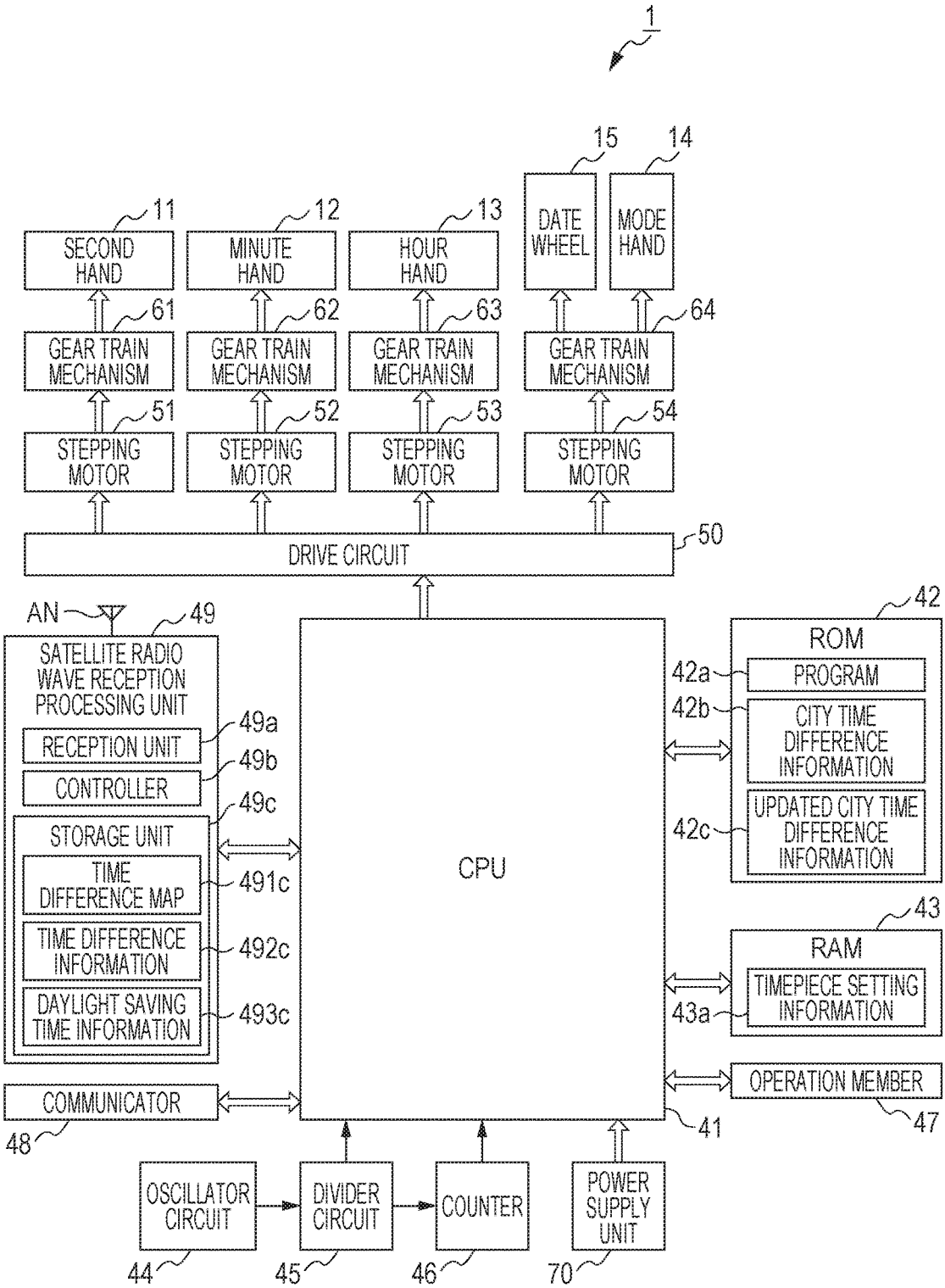
FIG. 2 is a block diagram illustrating a functional configuration of the electronic timepiece of the first embodiment.

The push button switches B1-B4 and the crown C1 each accept user's operation and output an electric signal as an operation acceptance signal to a CPU 41 (see FIG. 2). The push button switches B1-B4 each output an operation acceptance signal corresponding to pressing operation based on user operation or the like. In addition, the crown C1 is provided to be capable of being pulled out, and to be capable of rotation in a state of being pulled out. The crown C1 can be pulled out in two stages, and outputs operation acceptance signals respectively corresponding to pull-out operation, push-back operation, and rotational operation based on user operation and the like, to the CPU 41.

FIG. 2 is a block diagram illustrating a functional configuration of an electronic timepiece 1 of the present embodiment.

The electronic timepiece 1 includes: the CPU 41 (controller), ROM 42, RAM 43, an oscillator circuit 44, a divider circuit 45, a counter 46, an operation member 47, a communicator 48, a satellite radio wave reception processing unit 49 (positioning device, receiver) and an antenna AN, a drive circuit 50, a power supply unit 70, gear train mechanisms 61-64, stepping motors 51-54, and the hands 11-15 described above.

The CPU 41 is a processor that performs various types of calculation processing and integrally controls entire operation of the electronic timepiece 1. The CPU 41 controls hand operation relating to date and time display. The CPU 41 converts a date and time counted by the counter 46 to an appropriate local time on the basis of a local time setting including the time zone and daylight saving time implementation information, and displays the converted local time with the hands 11-15 in a normal time display mode.

In addition, the CPU 41 operates the communicator 48 and the satellite radio wave reception processing unit 49, and computes the date and time, location information, and various setting data. The CPU 41 corrects the date and time counted by the counter 46 on the basis of the obtained date and time data.

The ROM 42 stores a program 42*a* for various controls executed by the CPU 41 and the setting data. The program 42*a* includes a program relating to various functional mode operation controls, for example. In addition, the setting data includes city time difference information 42*b* and updated city time difference information 42*c* (both are collectively referred to as time difference information). The ROM 42 partially includes a nonvolatile memory that can be rewritten (time difference information can be updated from the initial setting and stored), such as a flash memory or an electrically erasable and programmable read only memory (EEPROM), and the setting data and the like can be updated.

The city time difference information 42*b* stores an ID of each of the local time markers provided on the outer edge of the bezel 4, a position of each of the local time markers (for example, the number of steps by the second hand 11 from the 12 o'clock direction), and a time difference from a UTC time (information relating to the time zone, hereinafter, the time difference represents the time difference from the UTC time) that are in association with each other, as time zone setting information. In addition to these, the city time difference information 42*b* may store the daylight saving time implementation information such as presence/absence of daylight saving time implementation in the set city, the daylight saving time implementation period, and the shift time during the implementation. Alternatively, the daylight saving time implementation information may be held as separate table data. The number of bits used for the ID of each of the local time markers and the maximum number of time zones that can be set are preferably provided so as to have a margin for a time zone newly set and added.

The updated city time difference information 42*c* stores the latest updated data of the city time difference information 42*b*. The format of the updated city time difference information 42*c* is the same as that of the city time difference information 42*b*.

FIG. 3A and FIG. 3B are charts each illustrating an example of the city time difference information 42*b* and the updated city time difference information 42*c*. For example, as illustrated in FIG. 3A, in the city time difference information 42*b*, the time difference "+9:00 (hours)" and the position "28 (seconds)" of the local time marker "TYO" indicating Tokyo and provided at the position of 28 seconds are associated with the ID "14" relating to Tokyo and stored. In addition, the time difference "+8:00 (hours)" and the position "26 (seconds)" of the local time marker "HKG" indicating Hong Kong and provided at the position of 26 seconds are associated with the ID "13" relating to Hong Kong and stored.

After that, for example, when the time difference in Tokyo is changed to "+8:00 (hours)" and the updated city time difference information 42*c* is computed, the time difference to be stored in association with the ID "14" relating to Tokyo is changed to "+8:00 (hours)" and held, as illustrated in FIG. 3B. That is, in this case, the time difference is +8 hours in both Hong Kong and Tokyo, and the local time marker corresponding to the time zone with a time difference of +9 hours does not exist on the bezel 4.

Incidentally, a storage area of the city time difference information 42*b* and a storage area of the updated city time difference information 42*c* can be configured to be alternately defined. That is, contents updated two times before are held as the city time difference information 42*b*, and contents most recently updated is held as the updated city time difference information 42*c*, and at the next update, the data of the city time difference information 42*b* is overwritten and updated to be new updated city time difference information 42*c*, and the conventional updated city time difference information 42*c* is changed to the city time difference information 42*b* as it is.

The RAM 43 provides a work memory space to the CPU 41 and temporarily stores data. In addition, the RAM 43 stores a history of date and time information and location information computation, an update history of the updated city time difference information 42*c*, the timepiece setting information 43*a* including local time setting information relating to normal basic timepiece display and world timepiece display, data indicating a hand position, and the like.

The timepiece setting information 43*a* stores setting information for computing the local time from the UTC date and time, such as a currently set home location (that is, normally the current location), and the time zone or the daylight saving time implementation rule in a world timepiece location, as local time setting data. In addition, when current location information is computed by the satellite radio wave reception processing unit 49 and used for a home location setting, the current location information is included in the timepiece setting information 43*a*.

The oscillator circuit 44 generates and outputs a predetermined frequency signal. The oscillator circuit 44 includes a crystal oscillator as an oscillator, for example.

The divider circuit 45 divides the frequency signal output from the oscillator circuit 44 into signals of frequencies used by the CPU 41 and the counter 46 and outputs the frequency signals. The output frequency may be changed and set by a control signal from the CPU 41.

The counter 46 counts a current date and time by counting the number of times of the divided signal input from the divider circuit 45 and adding the number of times to an initial value indicating a predetermined date and time. The date and time counted by the counter 46 can include an error (rate) depending on accuracy of the oscillator circuit 44, for example, about 0.5 seconds a day. The date and time counted by the counter 46 can be corrected by a control signal from the CPU 41. The date and time counted by the counter 46 may be a unique count value that can be converted to the date and time to be a reference such as the UTC date and time, and may be obtained by counting the UTC date and time itself. Alternatively, counting may be performed by performing correction to the local time in the home location for each time when the home location setting is performed. The counter 46 may have a counter circuit as a hardware configuration, or may be an aspect in which a value counted by software is stored in RAM or the like. In addition, the software counting may be controlled by the CPU 41, or may be controlled separately.

The operation member 47 accepts input operation from the user. The operation member 47 includes the push button switches B1-B4 and the crown C1 described above. When each of the push button switches B1-B4 is pressed, or the crown C1 is pulled out, pushed back, or rotated, an electric signal corresponding to the operation type is output to the CPU 41. In the electronic timepiece 1 of the present embodiment, it is possible to perform change of the home location setting and a world timepiece location setting and replacement of both settings on the basis of the input operation from the user, and to perform switching of a setting relating to presence/absence of application of daylight saving time for the date and time of the set time zone.

The communicator 48 has an interface for communicating with an external electronic device (external device). The communicator 48 performs transmission and reception of communication data by performing communication connection with the external device in accordance with the communication standard of wireless communication such as Bluetooth (registered trademark), for example. The new information to be held as the updated city time difference information 42*c* can be received by the communicator 48 via the external device such as a smart phone from a predetermined data server, for example.

The satellite radio wave reception processing unit 49 receives at least a radio wave from one of the positioning satellites including a positioning satellite relating to a global positioning system (GPS) (GPS satellite) by using the antenna AN, and demodulates a spectrum spread transmitted radio wave from these positioning satellites, and decodes and deciphers a signal (navigation message data). The satellite radio wave reception processing unit 49 performs various types of calculation processing to contents of the navigation message data deciphered as necessary, and computes the date and time and current location data, and the local time setting information corresponding to the current location in response to a request from the CPU 41, and outputs at least part of them to the CPU 41 in a preset format.

The satellite radio wave reception processing unit 49 includes a reception unit 49*a*, a controller 49*b*, and a storage unit 49*c*. The reception unit 49*a* has a reception circuit relating to amplification, tuning, and demodulation of a received radio wave from the positioning satellite. The controller 49*b* includes a CPU and RAM, and performs operation control relating to reception, decipherment, calculation and output. The calculation processing of the controller 49*b* includes date and time data computation processing and positioning calculation. The positioning calculation by the controller 49*b* is not limited to a case in which it is executed by software by the CPU, and may at least partially include processing by a dedicated hardware circuit or the like.

The storage unit 49*c* is configured by a nonvolatile memory such as a flash memory or electrically erasable and programmable read only memory (EEPROM), and holds the stored contents without depending on a power supply status for the satellite radio wave reception processing unit 49. In addition to various operation control programs and setting data such as a leap second correction value, and each positioning satellite's predicted orbit information computed from the positioning satellites, the storage unit 49*c* stores a time difference map 491*c* for obtaining the local time setting information corresponding to the current location obtained by positioning, and data tables such as time difference information 492*c* and daylight saving time information 493*c*. Incidentally, it may be configured such that these data tables are stored in the RAM 43 of the electronic timepiece 1, and the controller 49*b* receives part of the data from the CPU 41 as necessary and causes the CPU 41 to perform necessary processing. In addition, the operation control programs may be stored in a dedicated ROM, and read at startup to be loaded on the RAM of the controller 49*b*.

The time difference map 491*c* is map data in which a world map is divided into appropriate geographical blocks, and a parameter relating to the time zone to which each of the geographical blocks belongs, a parameter relating to the daylight saving time implementation rule in each of the geographical blocks, and the like are stored. As for the map of the time difference map 491*c*, although it is not particularly limited, the one is preferably used in which the latitude line and longitude line are each represented by a straight line and are drawn to be orthogonal to each other, and the geographical blocks are preferably arranged in a two-dimensional matrix at predetermined latitude and longitude intervals. Thus, it is possible to easily identify each of the geographical blocks to which the obtained current location belongs. In addition, each of the geographical blocks may be defined such that actual size does not differ greatly between the geographical blocks by making the longitude width different between a high latitude region and a low latitude region.

The time difference information 492*c* is table data in which a parameter relating to the time zone used in the time difference map 491*c* and the time difference in the time zone are associated with each other. In the table data, the parameter is set so as to uniquely correspond to the time difference, such that the time difference corresponding to the parameter "0" is "+0 hours," and the time difference corresponding to the parameter "1" is "+15 minutes," for example.

In addition, the daylight saving time information 493*c* is table data in which a parameter relating to the daylight saving time implementation rule used in the time difference map 491*c* and contents of the daylight saving time implementation rule (presence/absence of implementation, implementation period, and shift time during implementation) are associated with each other. For example, the parameters are set such that the parameter "0" is associated with a case of no daylight saving time implementation, and the parameter "1" is associated with a case in which the daylight saving time is implemented from one o'clock a.m. on the last Sunday in March to one o'clock a.m. on the last Sunday in October, in UTC, by shifting +1 hour.

In this way, a combination of the parameter relating to the time zone and the parameter relating to the daylight saving time implementation rule is defined for each of the geographical blocks.

Alternatively, in the time difference map 491*c*, it may be set such that only a region number is set simply depending on the administrative district and the like, and, in the time difference information 492*c* and the daylight saving time information 493*c*, the region number is associated with each of the time zone to which the administrative district corresponding to the region number belongs and the contents indicating the daylight saving time implementation rule, or further associated with a number corresponding to the contents.

The geographical block and the region number defined on the time difference map 491*c* can be associated with the city or region defined in the city time difference information 42*b* and the updated city time difference information 42*c*. Here, the geographical block and the region number are simply associated with the city or region in the time zone same as the identified geographical block and the region number.

The time difference map 491*c*, the time difference information 492*c*, and the daylight saving time information 493*c* can be updated. In the electronic timepiece 1, updated data for them are received via communication with the external device via the communicator 48, and overwritten and updated. In addition, similarly to the updated city time difference information 42*c* described above, it may be configured such that two areas are provided for each of these data, and the latest data and previous data are held in parallel by writing the latest data alternately.

These configurations of the satellite radio wave reception processing unit 49 are collectively formed on a chip as one module, and connected to the CPU 41. As for operation of the satellite radio wave reception processing unit 49, on/off control is performed independently from operation of other units of the electronic timepiece 1, by the CPU 41. In the electronic timepiece 1, when it is not necessary to operate the satellite radio wave reception processing unit 49, power saving is achieved by suspending power supply to the satellite radio wave reception processing unit 49.

The stepping motor 51 rotates the second hand 11 via the gear train mechanism 61 that is an arrangement of a plurality of gears. When the stepping motor 51 is driven once, the second hand 11 rotates six degrees in one step, and makes a round on the dial 3 by 60 times of operation of the stepping motor 51.

The stepping motor 52 rotates the minute hand 12 via the gear train mechanism 62. When the stepping motor 52 is driven once, the minute hand 12 rotates one degree in one step, and makes a round on the dial 3 by 360 times of operation of the stepping motor 52.

The stepping motor 53 rotates the hour hand 13 via the gear train mechanism 63. When the stepping motor 53 is driven once, the hour hand 13 rotates one degree in one step, and makes a round on the dial 3 by 360 times of operation of the stepping motor 53.

The stepping motor 55 rotates the mode hand 14 and the date wheel 15 in conjunction with each other via the gear train mechanism 65. When the stepping motor 55 is driven once, the mode hand 14 is rotated six degrees in one step. As for the date wheel 15, for example, 180 steps of rotational operation causes 360/31 degrees of rotation, and the date marker exposed from the opening 3*a* changes by 1 day. When the date wheel 15 rotates for 31 days, the date marker indicating the first date is again exposed from the opening 3*a*. Since the rotation angle ratio per one step between the mode hand 14 and the date wheel 15 is very large, the date wheel 15 does not largely rotate even when the mode hand 14 rotates somewhat. When the date displayed by the date wheel 15 is caused to change, it is sufficient that the mode hand 14 is rotated a plurality of times.

Although it is not particularly limited, the hands 11-15 are capable of rotational operation at 90 pulses per second (pps) in the normal rotation direction (the direction in which the time advances), and capable of rotational operation at 32 pps in the reverse rotation direction.

The drive circuit 50 outputs a drive pulse of a predetermined voltage to the stepping motors 51-54 in accordance with a control signal from the CPU 41 to rotate the stepping motors 51-54 at a predetermined angle (for example, 180 degrees) step. The drive circuit 50 is capable of changing the length (pulse width) of the drive pulse depending on a state of the electronic timepiece 1 or the like. In addition, when the control signal is input for simultaneously driving the multiple hands, it is possible to slightly shift the output timing of the drive pulse in order to reduce the load.

The power supply unit 70 supplies power at a predetermined voltage relating to operation of each unit from a battery. The power supply unit 70 includes, for example, a solar panel and a secondary battery, as the battery. Alternatively, the power supply unit 70 may obtain power from a replaceable button type dry battery and supply the power to each unit. When a plurality of different voltages is output from the power supply unit 70, the power supply unit 70 can be configured to be capable of outputting the voltages by performing conversion to desired voltages by using a switching power supply or the like, for example.

Next, local time setting operation will be described in the electronic timepiece 1 of the present embodiment.

In the electronic timepiece 1, it is possible to switch a basic timepiece for displaying local time in the current location (home location) and a world timepiece for displaying local time in a specified predetermined point of the world (world timepiece location) to each other as a date and time to be displayed, and to independently set each of the home location and the world timepiece location. The home location can be automatically set depending on current location information computed by operation of the satellite radio wave reception processing unit 49.

In addition, the home location and the world timepiece location can be each manually set by user's operation without computing the current location information by the satellite radio wave reception processing unit 49. In the electronic timepiece 1 of the present embodiment, it is possible to select the city or region stored in the city time difference information 42*b* and the updated city time difference information 42*c* described above, that is, the city or region corresponding to the local time marker provided on the bezel 4, as the location of the city or region, and, as for locations other than these, it is possible to count and display the basic timepiece and the world timepiece by directly setting the local time, that is, the time difference.

In addition, in the electronic timepiece 1, it is possible to switch timepiece setting information relating to a basic timepiece function and timepiece setting information relating to a world timepiece function to each other, that is, it is possible to perform replacement between the home location and the world timepiece location.

First, automatic setting will be described of home location by radio wave reception from the positioning satellite.

Figure 4:
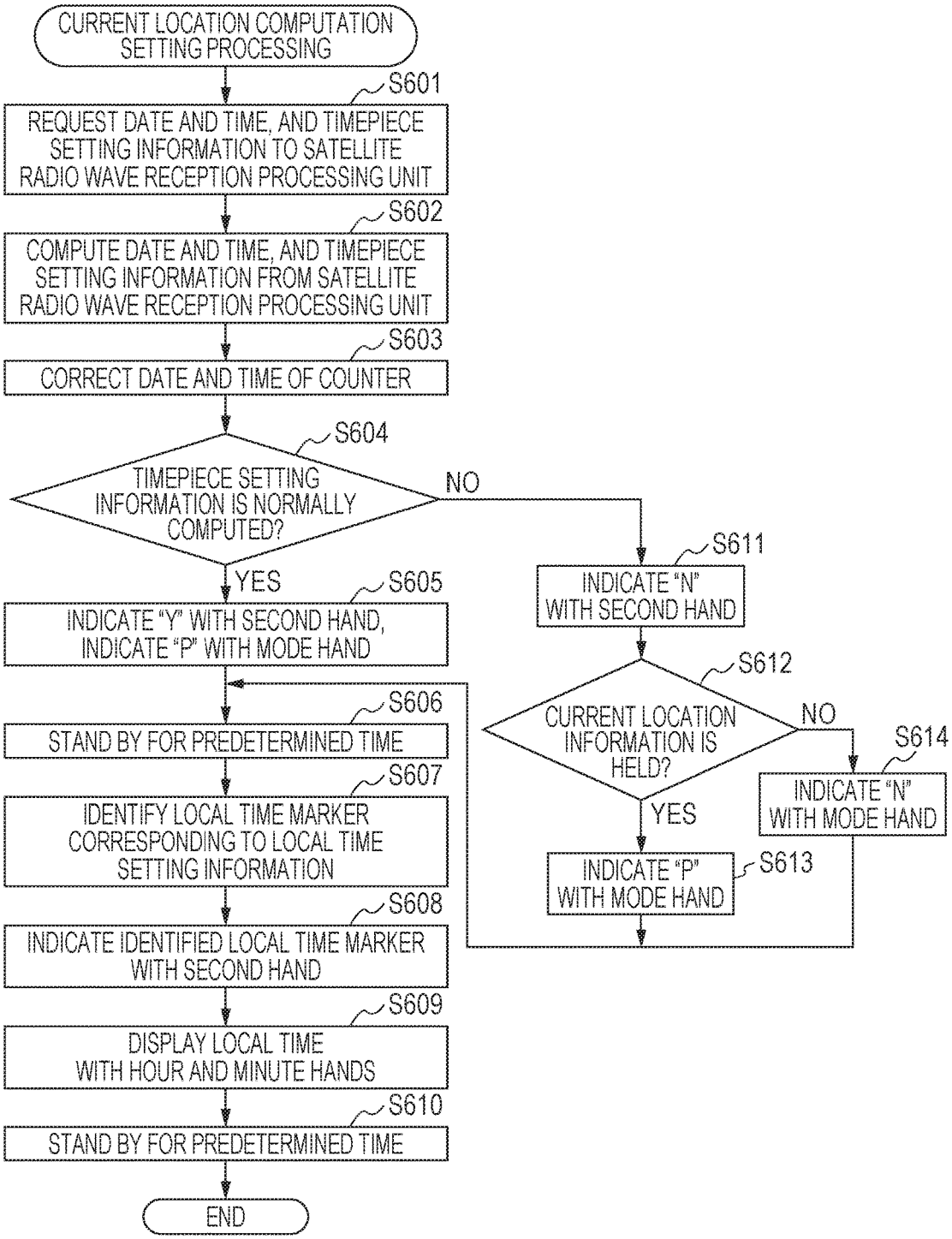
FIG. 4 is a flowchart illustrating a control procedure of current location computation setting processing.

FIG. 4 is a flowchart illustrating a control procedure by the CPU 41 of current location computation setting processing.

The current location computation setting processing is started by particular input operation by the user, here, operation in which the push button switch B4 is continuously pressed for three seconds or more. Alternatively, the processing may be automatically started by a predetermined condition, for example, once a day at a predetermined timing.

When the current location computation setting processing is started, the CPU 41 requests the date and time information and timepiece setting information relating to the basic timepiece (current location information and local time setting information) to the satellite radio wave reception processing unit 49 (step S601). Then, the CPU 41 waits for an input from the satellite radio wave reception processing unit 49, and computes the date and time computed on the basis of radio wave reception from the positioning satellite, a positioning result (obtained current location information), and local time setting information obtained from the time difference map 491*c*, the time difference information 492*c*, and the daylight saving time information 493*c* on the basis of the current location information from the satellite radio wave reception processing unit 49, and stores the information as a timepiece setting relating to the basic timepiece in the timepiece setting information 43*a* (step S602). The CPU 41 corrects the date and time counted by the counter 46 (step S603).

The CPU 41 determines whether or not the timepiece setting information is normally computed by the satellite radio wave reception processing unit 49 (step S604). When it is determined that the timepiece setting information is normally computed ("YES" in step S604), the CPU 41 outputs a control signal to the drive circuit 50, and causes the second hand 11 to indicate the marker "Y," and causes the mode hand 14 to indicate the marker "P" (step S605). Then, the processing of the CPU 41 proceeds to step S606.

When it is determined that the timepiece setting information is not normally computed ("NO" in step S604), the CPU 41 outputs a control signal to the drive circuit 50 to cause the second hand 11 to indicate the marker "N" provided on the periphery of the dial 3 (step S611). The CPU 41 determines whether or not the current location information has been held before the start of the current location computation setting processing (step S612). When it is determined that the current location information has been held ("YES" in step S612), the CPU 41 outputs a control signal to the drive circuit 50 to cause the mode hand 14 to indicate the marker "P" (step S613), and then the processing proceeds to step S606. When it is determined that the current location information has not been held ("NO" in step S612), the CPU 41 outputs a control signal to the drive circuit 50 to cause the mode hand 14 to indicate the marker "N" in the small window 3*b* (step S614), and then the processing proceeds to step S606.

When the processing proceeds to step S606, the CPU 41 stands by for a predetermined time, for example, two seconds (step S606). The CPU 41 identifies the local time marker of the city or region corresponding to the computed local time setting information (time zone) (step S607). When there is no corresponding city or region, the CPU 41 selects the exception marker as the corresponding local time marker. The CPU 41 can perform the processing in step S607 during the standby time in step S606.

The CPU 41 outputs a control signal to the drive circuit 50, and causes the second hand 11 to indicate the identified local time marker (when branched to "NO" in step S604, the marker associated with conventional local time setting information) (step S608). The CPU 41 can additionally store a newly identified local time marker (ID) in the timepiece setting information 43*a*.

The CPU 41 outputs a control signal to the drive circuit 50, and causes the hour and minute hands 12, 13 to display the current local time (step S609). In addition, when the date changes during display of the local time, the CPU 41 rotates the date wheel 15 to align both the position indicated by the mode hand 14 and the date to respective correct positions. The CPU 41 stands by for a predetermined time (step S610), and then ends the current location computation setting processing.

Next, manual setting will be described of the home location and the world timepiece location. The electronic timepiece 1 proceeds to a manual setting state of the home location or world timepiece location by pulling out the crown C1 to a first stage or a second stage, respectively. Then, the second hand 11 is moved depending on crown C1 rotational operation, and the local time marker of the desired city or region is indicated, whereby the time zone setting is performed.

FIG. 5 is a flowchart illustrating a control procedure by the CPU 41 of local time manual setting processing.

The local time manual setting processing is started by detection of crown C1 pull-out operation.

When the local time manual setting processing is started, the CPU 41 determines whether or not the crown C1 is in a first stage pull-out state (step S501). When it is determined that the crown C1 is in the first stage pull-out state ("YES" in step S501), the CPU 41 reads and computes the timepiece setting information relating to the world timepiece, and outputs a control signal to the drive circuit 50, and causes the hour and minute hands 12, 13 to indicate the current time (local time) corresponding to the local time setting information relating to the world timepiece. In addition, the CPU 41 causes the second hand 11 to indicate the local time marker of the city or region corresponding to the time zone of the world timepiece location (when there is no corresponding local time marker, the exception marker) (step S502). At this time, the CPU 41 can rotate the date wheel 15 and display the correct date, simultaneously.

The CPU 41 determines whether or not the current location information is included in the timepiece setting information relating to the world timepiece (step S503). When it is determined that the current location information is included ("YES" in step S503), the CPU 41 outputs a control signal to the drive circuit 50 to cause the mode hand 14 to indicate the marker "P" (step S506), and then the processing proceeds to step S508. When it is determined that the current location information is not included ("NO" in step S503), the CPU 41 outputs a control signal to the drive circuit 50 to cause the mode hand 14 to indicate the marker "N" (step S507), and then the processing proceeds to step S508.

When it is determined that the crown C1 is not in the first stage pull-out state, that is, in a second stage pull-out state ("NO" in step S501), the CPU 41 reads the timepiece setting information relating to the basic timepiece, outputs a control signal to the drive circuit 50, and causes the hour and minute hands 12, 13 to indicate the current local time corresponding to the local time setting information relating to the basic timepiece. In addition, the CPU 41 causes the second hand 11 to indicate the local time marker of the city or region corresponding to the time zone of the home location (when there is no corresponding local time marker, the exception marker) (step S504).

The CPU 41 determines whether or not the current location information is included in the timepiece setting information relating to the basic timepiece (step S505). When it is determined that the current location information is included ("YES" in step S505), the CPU 41 outputs a control signal to the drive circuit 50 to cause the mode hand 14 to indicate the marker "P" (step S506), and then the processing proceeds to step S508. When it is determined that the current location information is not included ("NO" in step S505), the CPU 41 outputs a control signal to the drive circuit 50, and causes the mode hand 14 to indicate the marker "N" (step S507), and then the processing proceeds to step S508.

When the processing proceeds from steps S506, S507 to step S508, the CPU 41 determines whether or not crown C1 pull-out or push-back operation is detected (step S508). When it is determined that the operation is not detected ("NO" in step S508), the CPU 41 determines whether or not the push button switch B3 is continuously pressed for one second or more (step S509). When it is determined that the push button switch B3 is continuously pressed for one second or more ("YES" in step S509), the CPU 41 executes time difference manual setting processing described later (step S520), and then the processing proceeds to step S524.

When it is determined that the push button switch B3 is not continuously pressed for one second or more ("NO" in step S509), the CPU 41 determines whether or not crown C1 rotational operation (first input operation) is detected (step S510). When it is determined that the rotational operation is not detected ("NO" in step S510), the processing of the CPU 41 returns to step S508.

When it is determined that the crown C1 rotational operation is detected ("YES" in step S510), the CPU 41 determines whether or not the current location information is included in the timepiece setting information about the timepiece function (basic timepiece/world timepiece) being displayed and set (step S511). When it is determined that the current location information is included ("YES" in step S511), the current location information is deleted, and a control signal is output to the drive circuit 50, and the mode hand 14 is moved to the position of the marker "N" in the small window 3*b* (step S512). Then, the processing of the CPU 41 proceeds to step S513. When it is determined that the current location information is not included ("NO" in step S511), the processing of the CPU 41 proceeds to step S513.

When the processing proceeds to step S513, the CPU 41 outputs a control signal to the drive circuit 50, and moves the second hand 11 to a position of the local time marker provided next to the local time marker currently selected, regarding the detected crown C1 rotation direction. That is, when the neighboring local time marker regarding the rotation direction is the exception marker, the CPU 41 moves the second hand 11 by four steps so that the exception marker is skipped, and, when the neighboring local time marker is the location marker indicating the normal city or region, or the reference marker indicating UTC, the CPU 41 moves the second hand 11 by two steps. In addition, the CPU 41 computes the time difference in the city (region) corresponding to the local time marker, computes the local time of the city on the basis of the date and time counted by the counter 46, and outputs a control signal to the drive circuit 50 to cause the hour and minute hands 12, 13 to indicate the local time (step S513). In addition, when the date changes, the CPU 41 rotates the date wheel 15 to display the correct date, and in this state, moves the mode hand 14 to the position of the marker "N." Then, the processing of the CPU 41 returns to step S508.

In the determination processing in step S508, when it is determined that crown C1 pull-out operation or push-back operation is detected ("YES" in step S508), the CPU 41 determines whether or not the crown C1 has been in the first stage pull-out state before the detected operation (step S521). When it is determined that the crown C1 has been in the first stage pull-out state ("YES" in step S521), the CPU 41 fixes the local time setting relating to the local time marker currently indicated by the second hand 11, and the local time indicated by the minute hand 12 and hour hand 13, as the local time setting relating to the world timepiece, and holds and stores the local time setting in the timepiece setting information 43*a* (step S522). Then, the processing of the CPU 41 proceeds to step S524.

When it is determined that the crown C1 has not been in the first stage pull-out state, that is, the crown C1 has been in the second stage pull-out state ("NO" in step S521), the CPU 41 fixes the local time setting relating to the local time marker currently indicated by the second hand 11, and the local time indicated by the minute hand 12 and hour hand 13, as the local time setting relating to the basic timepiece, and stores and holds the local time setting in the timepiece setting information 43*a* (step S523). Then, the processing of the CPU 41 proceeds to step S524.

When the processing proceeds to steps S520, S522, S523 to step S524, the CPU 41 determines whether or not the crown C1 after the detected crown C1 operation is in a state not pulled out (step S524). When it is determined that the crown C1 is not pulled out ("YES" in step S524), the CPU 41 ends the local time manual setting processing. When it is determined that the crown C1 is pulled out ("NO" in step S524), the processing of the CPU 41 returns to step S501.

Figure 6:
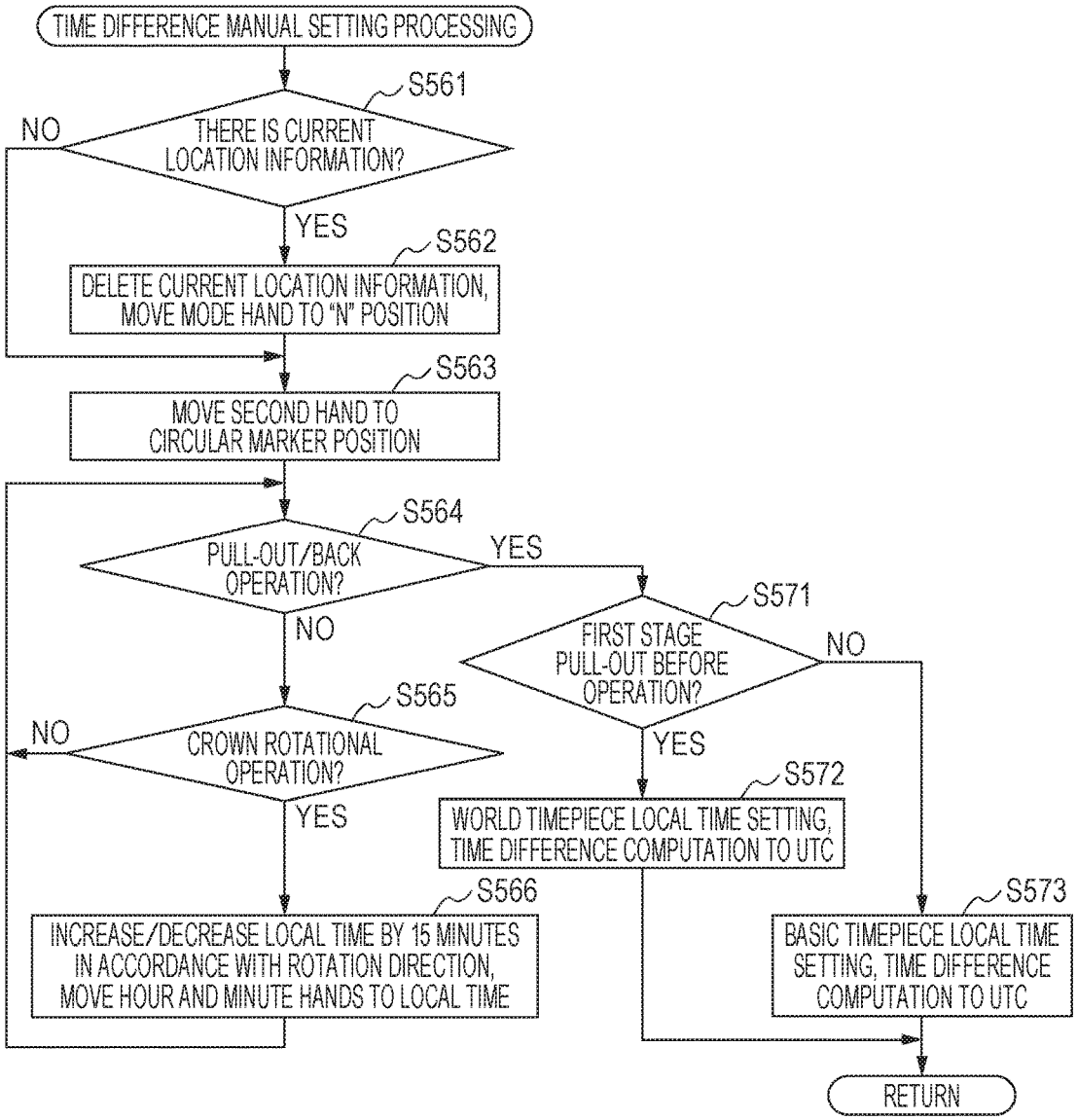
FIG. 6 is a flowchart illustrating a control procedure of time difference manual setting processing called in the local time manual setting processing.

FIG. 6 is a flowchart illustrating a control procedure by the CPU 41 of time difference manual setting processing called in step S520 of the local time manual setting processing.

When the time difference manual setting processing is called, the CPU 41 determines whether or not the current location information is held as the timepiece setting information relating to the timepiece function (basic timepiece/world timepiece) during display (step S561). When it is determined that the current location information is held ("YES" in step S561), the CPU 41 erases the current location information, and outputs a control signal to the drive circuit 50 to cause the mode hand 14 to indicate the marker "N" in the small window 3*b* (step S562). Then, the processing of the CPU 41 proceeds to step S563.

When it is determined that the current location information is not held ("NO" in step S561), the processing of the CPU 41 proceeds to step S563.

When the processing proceeds from steps S561, S562 to step S563, the CPU 41 outputs a control signal to the drive circuit 50, and causes the second hand 11 to indicate the exception marker (step S563). The CPU 41 determines whether or not crown C1 pull-out operation or push-back operation is detected (step S564).

When it is determined that the crown C1 pull-out operation or push-back operation is not detected ("NO" in step S564), the CPU 41 determines whether or not crown C1 rotational operation (second input operation) is detected (step S565). When it is determined that the rotational operation is not detected ("NO" in step S565), the processing of the CPU 41 returns to step S564. When it is determined that the rotational operation is detected ("YES" in step S565), the CPU 41 increases or decreases the local time by 15 minutes depending on the rotation direction of the crown C1 for the timepiece function (world timepiece/basic timepiece) currently to be set, outputs a control signal to the drive circuit 50 to quickly move the hour and minute hands 12, 13, and changes the local time displayed by the hour and minute hands 12, 13 by 15 minutes (step S566). When the date and time changes with the change of the local time, the CPU 41 rotates the date wheel 15 to change the date, and causes the mode hand 14 to indicate the marker "N" in this state. Then, the processing of the CPU 41 returns to step S564.

When it is determined that the crown C1 pull-out operation or push-back operation is detected in the determination processing in step S564 ("YES" in step S564), the CPU 41 determines whether or not the crown C1 has been in the first stage pull-out state before the detected operation (step S571). When it is determined that the crown C1 has been in the first stage pull-out state ("YES" in step S571), the CPU 41 sets the date and time indicated by the hour and minute hands 12, 13 and the date wheel 15 as the current local time in the world timepiece location, computes the time difference information from a difference from the date and time counted by the counter 46 to define the time zone, and stores and holds the information as the local time setting information relating to the world timepiece in the timepiece setting information 43*a* (step S572). Then, the CPU 41 ends the time difference manual setting processing and returns the processing to the local time manual setting processing.

When it is determined that the crown C1 has not been in the first stage pull-out state, that is, has been in the second stage pull-out state ("NO" in step S571), the CPU 41 sets the date and time indicated by the hour and minute hands 12, 13 and the date wheel 15 as the current local time in the home location, computes the time difference information from a difference from the date and time counted by the counter 46 to define the time zone, and stores and holds the information as local time setting information relating to the basic timepiece in the timepiece setting information 43*a* (step S573). Then, the CPU 41 ends the time difference manual setting processing and returns the processing to the local time manual setting processing.

Figure 7:
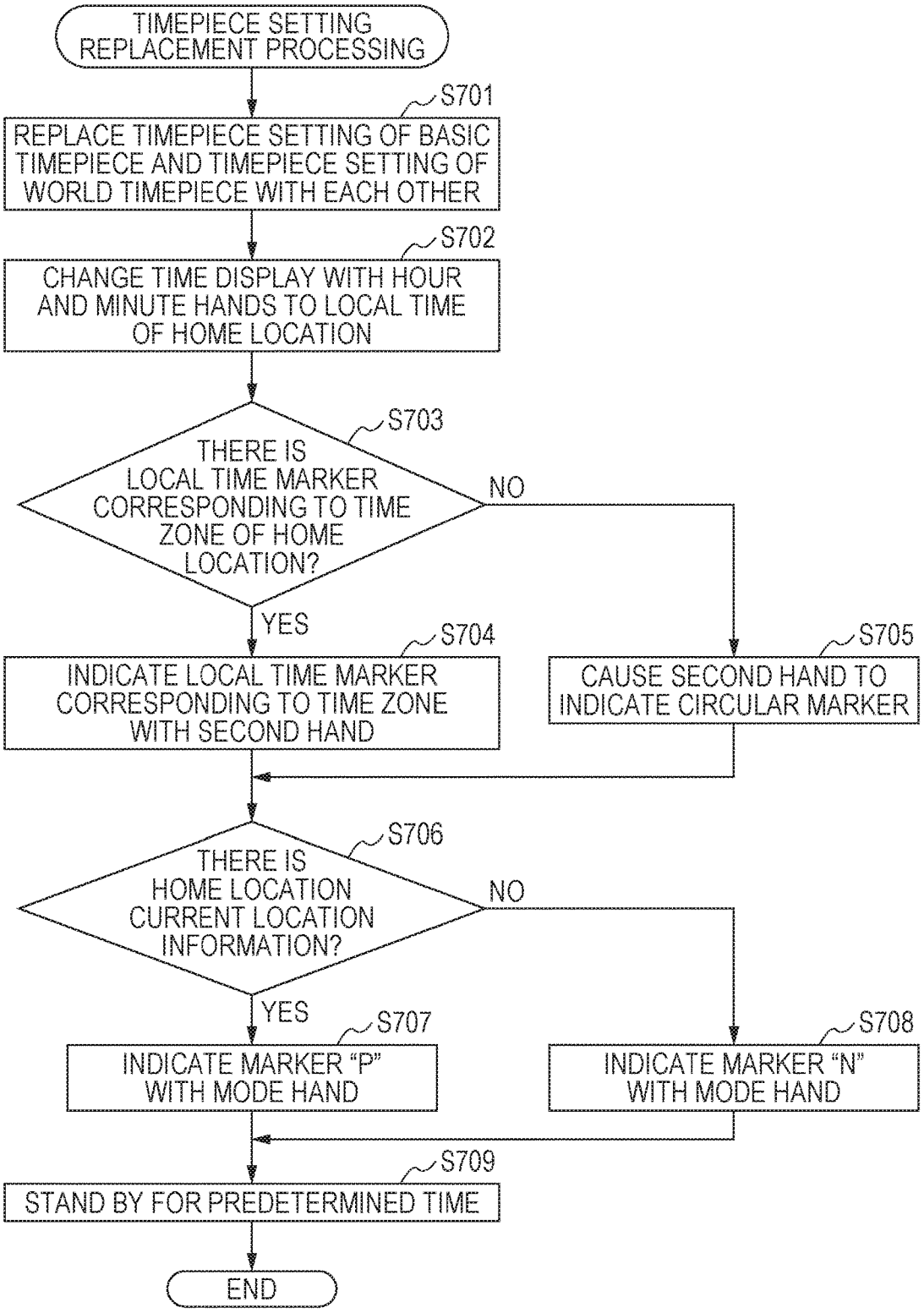
FIG. 7 is a flowchart illustrating a control procedure of timepiece setting replacement processing.

FIG. 7 is a flowchart illustrating a control procedure by the CPU 41 of timepiece setting replacement processing executed by the electronic timepiece 1 of the present embodiment.

The timepiece setting replacement processing is started in response to a predetermined input operation, for example, a state in which the user continuously presses the push button switch B4 for three seconds or more.

When the timepiece setting replacement processing is started, the CPU 41 replaces the timepiece setting relating to the world timepiece and the timepiece setting relating to the basic timepiece in the timepiece setting information 43*a* with each other (step S701). The CPU 41 computes the local time of the home location in accordance with the local time setting of the home location defined by the timepiece setting relating to the basic timepiece, and outputs a control signal to the drive circuit 50 to change the time display by the hour and minute hands 12, 13 to the local time (step S702).

The CPU 41 determines whether or not there is a local time marker of the city or region corresponding to the time zone of the replaced home location (step S703).

When it is determined that there is the local time marker ("YES" in step S703), the CPU 41 outputs a control signal to the drive circuit 50, and causes the second hand 11 to indicate the local time marker (step S704). Then, the processing of the CPU 41 proceeds to step S706. When it is determined that there is no local time marker of the city or region corresponding to the time zone of the replaced home location ("NO" in step S703), the CPU 41 outputs a control signal to the drive circuit 50, and causes the second hand 11 to indicate the exception marker (step S705). Then, the processing of the CPU 41 proceeds to step S706.

When the processing proceeds to step S706, the CPU 41 determines whether or not the current location information is included in the timepiece setting information relating to the basic timepiece after the replacement (step S706). When it is determined that the current location information is included ("YES" in step S706), the CPU 41 outputs a control signal to the drive circuit 50, and causes the mode hand 14 to indicate the marker "P" (step S707). Then, the processing of the CPU 41 proceeds to step S709. When it is determined that the current location information is not included ("NO" in step S706), the CPU 41 outputs a control signal to the drive circuit 50, and causes the mode hand 14 to indicate the marker "N" in the small window 3*b* (step S708). Then, the processing of the CPU 41 proceeds to step S709.

When the processing proceeds to step S709, the CPU 41 maintains the display and stands by for a predetermined time, for example, two seconds (step S709). Then, the CPU 41 ends the timepiece setting replacement processing.

FIGS. 8A to 8C and FIGS. 9A and 9B are diagrams each illustrating a display example of a location setting by the electronic timepiece 1 of the present embodiment.

Figure 8A:
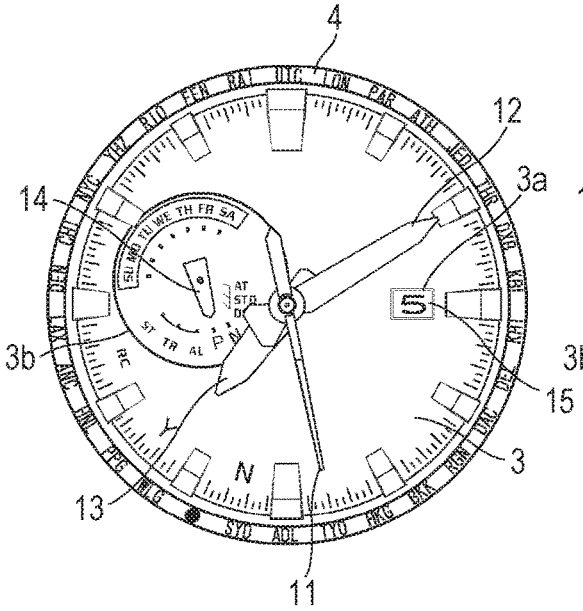
FIG. 8A is a diagram illustrating a display example of a location setting by the electronic timepiece of the first embodiment.

When it is set to a time zone of UTC+9 hours such as Tokyo or Jayapura in Indonesia on the basis of the city time difference information 42*b* illustrated in FIG. 3A by user operation or radio wave reception from the positioning satellite at 10:10 UTC, the local time is 19:10, and the hour and minute hands 12, 13 indicate 7:10 as illustrated in FIG. 8A. In addition, the mode hand 14 indicates the marker "P," and the second hand 11 indicates the local time marker "TYO" corresponding to UTC+9.

Figure 8B:
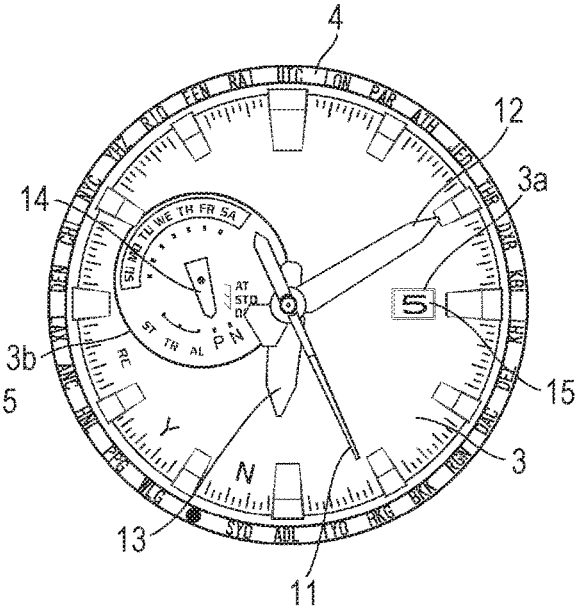
FIG. 8B is a diagram illustrating a display example of a location setting by the electronic timepiece of the first embodiment.

When the updated city time difference information 42*c* illustrated in FIG. 3B, and the updated data of the time difference map 491*c* and the like are computed and then it is identified that the current location is Tokyo by the radio wave reception from the positioning satellite at 10:10 UTC, for the basic timepiece display, the local time 18:10 is computed on the basis of the updated city time difference information 42*c* and the updated time difference map 491*c*, and 6:10 is indicated by the hour and minute hands 12, 13, as illustrated in FIG. 8B. At this time, control is performed so that the mode hand 14 indicates the marker "P," and the second hand 11 indicates the local time marker "HKG" that is initially set as UTC+8.

Figure 8C:
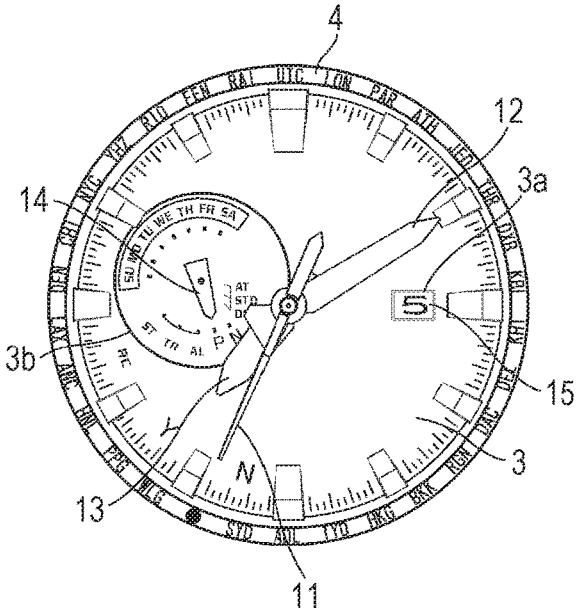
FIG. 8C is a diagram illustrating a display example of a location setting by the electronic timepiece of the first embodiment.

When the updated city time difference information 42*c* and the updated data of the time difference map 491*c* are computed and then it is identified that the current location is Jayapura in Indonesia by the radio wave reception from the positioning satellite at 10:10 UTC, for the basic timepiece display, the local time 19:10 is computed, and 7:10 is indicated by the hour and minute hands 12, 13, as illustrated in FIG. 8C. At this time, the mode hand 14 indicates the marker "P," and the second hand 11 indicates that the time difference is UTC+9 that does not exist on the bezel 4 by indicating the exception marker.

Figure 9A:
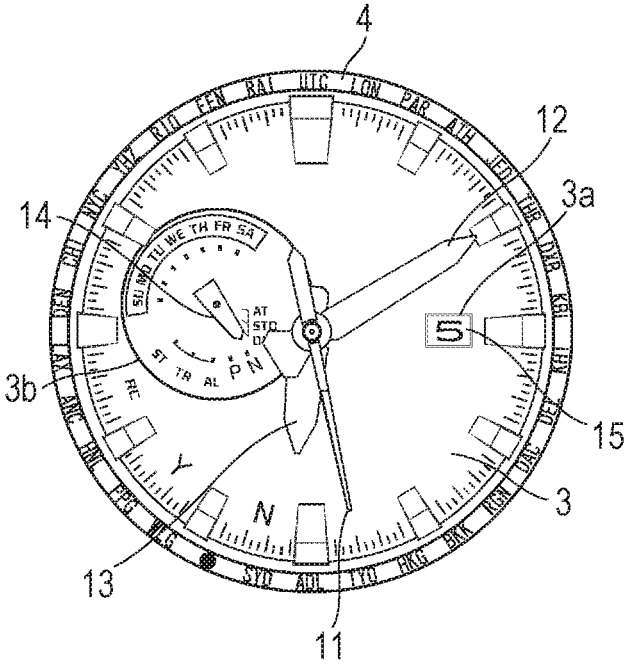
FIG. 9A is a diagram illustrating a display example of a location setting by the electronic timepiece of the first embodiment.

When the updated city time difference information 42*c* is computed and then the home location is set to Tokyo by user operation at 10:10 UTC, the second hand 11 indicates the local time marker "TYO," and the mode hand 14 indicates the marker "N," with this setting, as illustrated in FIG. 9A. At this time, time display by the hour and minute hands 12, 13 is 6:10 correspondingly to 18:10 that is UTC+8 hours.

Figure 9B:
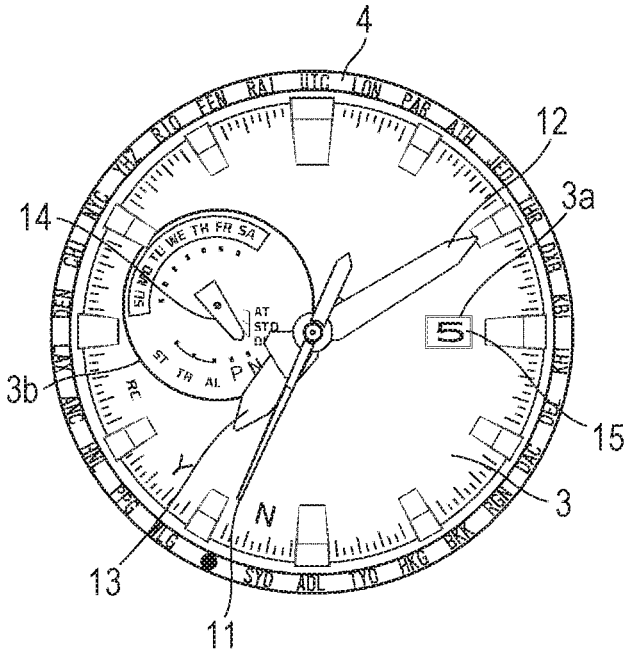
FIG. 9B is a diagram illustrating a display example of a location setting by the electronic timepiece of the first embodiment.

In this situation, when the user desires to set the time display to that of UTC+9 hours such as Jayapura in Indonesia, the user can set the display time to 7:10 corresponding to 19:10 that is UTC+9 hours, on the basis of the time difference manual setting processing, as illustrated in FIG. 9B. At this time, the indication position of the mode hand 14 is the marker "N," and the local time marker indicated by the second hand 11 is the exception marker.

As described above, the electronic timepiece 1 of the present embodiment includes: the bezel 4 on which the multiple local time markers for indicating locations in various places of the world; the second hand 11 that moves relative to the bezel 4; the ROM 42 that stores the city time difference information 42*b* in which each of the local time markers and the information relating to the time zone to which the position indicated by each of the local time markers belongs are associated with each other; and the CPU 41 that performs operation control for moving the second hand 11 relative to the bezel 4, and the bezel 4 is provided with the exception marker representing non-correspondence to any time zone associated with each of the local time markers by being indicated by the second hand 11 (by being in the predetermined positional relationship), and the CPU 41 causes the second hand 11 to indicate the exception marker when there is not any of the location markers each associated with a set time zone, during display relating to the set time zone for the date and time to be displayed.

Thus, it is not necessary to stuff all the markers corresponding to the respective time zones or to arrange the markers at intervals corresponding to the time difference, and in particular it is possible to omit the markers or spaces for the cities or regions that are assumed to have a low frequency of use for setting, so that it is possible to perform time zone display flexibly and appropriately.

In addition, the ROM 42 is capable of storing the updated city time difference information 42*c* for updating the city time difference information 42*b*. Thus, it is possible to make appropriate local time display with normal operation without replacing the entire timepiece even when the time zone is changed to which the city or region set on the bezel belongs. In addition, it is possible to prevent occurrence of a problem such that the position for indicating the time zone does not exist or misleads the user when the time zone is changed and the city or region corresponding to the time zone to be set disappears or is newly set.

In addition, the CPU 41 does not use the local time marker whose associated time zone has been changed from the initial setting, for display relating to the set time zone.

Thus, the user is not confused due to the time point at which the time zone corresponding to the local time marker indicated is set.

In addition, the communicator 48 is included that receives from the external device the updated city time difference information 42*c* to be updated and stored. Thus, it is possible to easily change an internal setting of the electronic timepiece, in particular, the time zone setting data that is often changed, so that it is possible to display the correct local time flexibly and appropriately.

In addition, since the exception marker is indicated by the predetermined marker, it is easily indicated that it is in an area other than the time zone corresponding to the city indicated by the local time marker.

In addition, the operation member 47 is included that accepts input operation, and the CPU 41 performs time zone setting for the date and time to be displayed on the basis of predetermined input operation to the push button switches B1-B4 and the crown C1, and causes the second hand 11 to indicate the exception marker when the set time zone does not correspond to any of the local time markers, to perform display relating to the set time zone.

Thus, it is possible to perform display of the time zone of the local time appropriately and flexibly during setting of the local time to be displayed.

In addition, the counter 46 is included that counts the date and time to be a reference, here, the UTC date and time, and the CPU 41 performs time zone setting on the basis of the difference between the date and time to be the reference and the current date and time accepted via the predetermined input operation. In this way, not only the time zone setting by selection of the city, a specific date and time may be input and local time setting may be performed by its time difference. Even in this case, it is possible to display the set time zone similarly, and it is possible to flexibly deal with cases such that the time zone does not correspond to the city provided on the bezel 4, and the time zone has initially corresponded to the city but no longer corresponds because it is changed.

In addition, the CPU 41 causes the second hand 11 to indicate the predetermined local time marker by the crown C1 rotational operation (first input operation), causes the hour and minute hands 12, 13 to display the date and time in the time zone associated with the local time marker indicated by the position of the second hand 11 changed, as the date and time to be displayed, changes the date and time displayed by the hour and minute hands 12, 13 by continuous press of the push button switch B3 for one second or more and subsequent rotation of the crown C1 (second input operation), and sets the time zone on the basis of the difference between the date and time changed and the date and time to be the reference counted by the counter 46. Therefore, even when a time zone is set other than the time zone corresponding to the city whose local time marker is provided on the bezel 4, or when the time zone has been changed of the city or region indicated by the local time marker though the user has thought that the city or region corresponds to the time zone, it is possible to appropriately perform time zone setting, and, to reasonably display the time zone defined in accordance with the setting.

In addition, the electronic timepiece 1 includes the satellite radio wave reception processing unit 49 that computes information relating to the current location, and the storage unit 49*c* that stores a correspondence relationship between the current location computed by the satellite radio wave reception processing unit 49 and the time zone, as the time difference map 491*c*, and the controller includes the controller 49*b* of the satellite radio wave reception processing unit 49, and the controller 49*b* identifies the time zone to which the current location computed by the satellite radio wave reception processing unit 49 belongs on the basis of the time difference map 491*c*. In this way, not only the case in which the user manually performs setting, even when the current location is computed on the basis of positioning data, it is possible to appropriately perform time zone setting depending on the current location, and to perform display of the set time zone flexibly and appropriately.

In addition, the storage unit 49*c* is capable of updating and storing the correspondence relationship. Therefore, similarly to the updated city time difference information 42*c* described above, it is possible to flexibly deal with change of time zone setting of various places of the world, and to perform display of the time zone that is dealt with in this way and correctly defined, flexibly and appropriately.

In addition, the information relating to the current location is computed by the satellite radio wave reception processing unit 49, and the mode hand 14 is included that indicates whether or not the time zone corresponding to the current location is used for setting of the date and time to be displayed.

Thus, it is possible to easily determine whether the time zone setting is manually performed by the user or automatically performed on the basis of the positioning result.

In addition, the satellite radio wave reception processing unit 49 operates as a receiver for performing positioning by receiving the radio wave from the positioning satellite. Therefore, it is possible to compute the current location information at various places of the world easily and reliably. In addition, it is possible to perform time zone setting reliably even at a region different from the city or region relating to the local time marker provided on the bezel 4, on the basis of latitude and longitude information. In addition, by a combination of indication of the local time marker by the second hand 11 and indication of the marker "P," or "N" by the mode hand 14, it is possible for the user to determine whether the appropriate time zone setting is automatically performed in this way, and to perform setting so as to display the desired local time easily and appropriately while reducing user's labor relating to time zone setting.

In addition, the hand is the second hand 11 provided to be capable of rotational operation, and the CPU 41 causes the second hand 11 to rotate and causes the second hand 11 to indicate one of the local time markers provided on the bezel 4, so that it is possible to widen the range of design variously while enabling easy time zone setting by using original operation of the timepiece.

In addition, the display method in the electronic timepiece 1 of the embodiment of the present invention includes: an exception location setting step of setting on the bezel 4 the exception indication position (exception marker) representing non-correspondence to any time zone associated with each of the local time markers by being indicated by the second hand 11; and a display step of moving the second hand 11 and the bezel 4 relative to each other, and causing the second hand 11 to indicate the exception indication position when there is not any of the local time markers each associated with a set time zone, during display relating to the set time zone for the date and time to be displayed. In this way, by the exception indication position collectively indicating a portion that cannot be indicated by the normal location markers, it is possible to perform time zone display flexibly and appropriately.

Second Embodiment

Next, an electronic timepiece of a second embodiment will be described.

Figure 10:
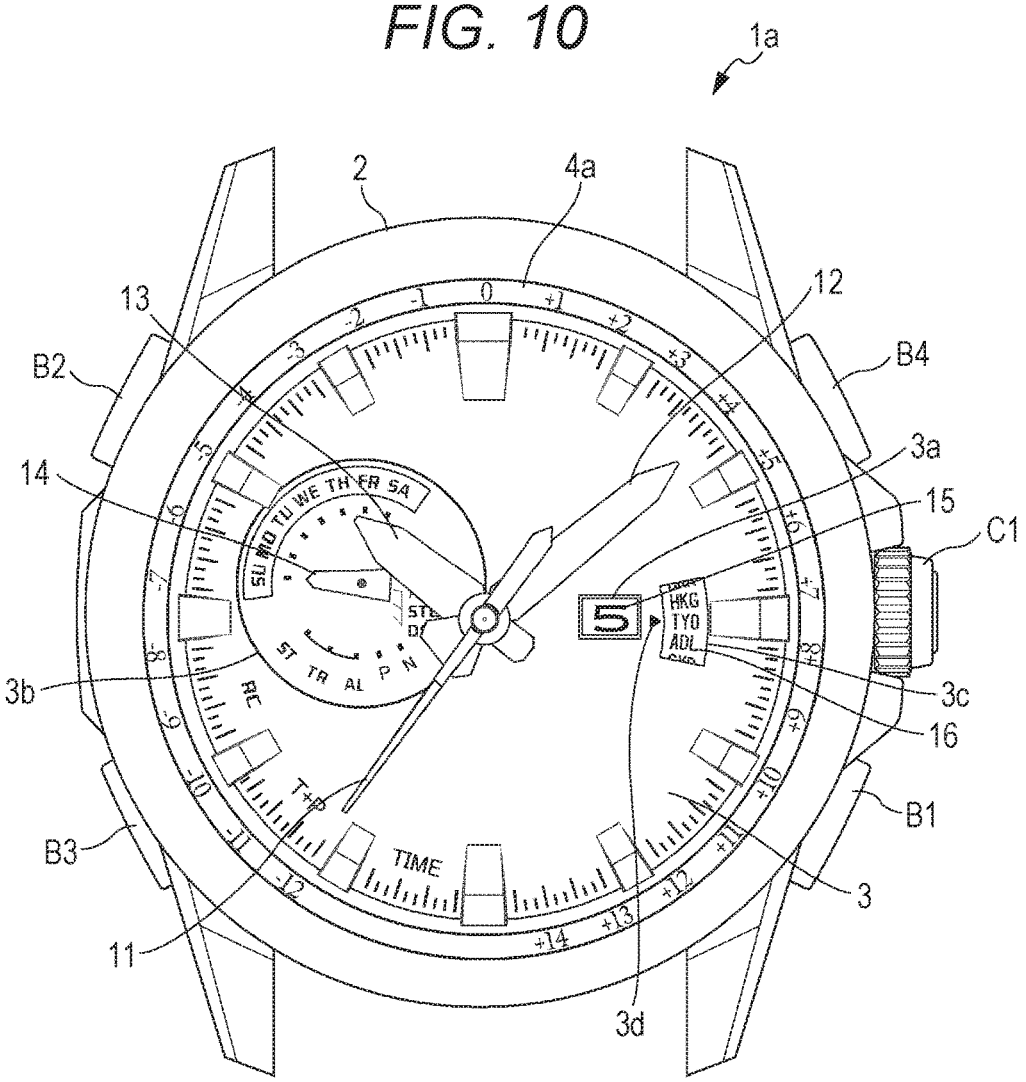
FIG. 10 is a front view illustrating an appearance of an electronic timepiece of a second embodiment.

FIG. 10 is a front view illustrating an appearance of an electronic timepiece 1*a* of the present embodiment.

In the electronic timepiece 1*a* of the second embodiment, the dial 3 of the electronic timepiece 1 of the first embodiment is further provided with an opening 3*c*, and local time markers can be selectively exposed that are provided on the front face of a location display disc 16 provided to be capable of rotation in the rear face side of the dial 3 that is a fixed disc. The opening 3*a* is provided closer to the rotation axis of the hands 11-13, 15 than that in the electronic timepiece 1 of the first embodiment, and along with this, the date wheel 15 is formed to be small so as not to be exposed from the opening 3*c*. In addition, markers "TIME," "T+P" are provided instead of the markers "Y," "N" of the dial 3. In addition, the bezel 4 is replaced by a bezel 4*a*. Other configurations are the same as each other in the electronic timepiece 1 and the electronic timepiece 1*a*, and the same components are denoted by the same reference numerals and descriptions thereof are omitted.

The opening 3*c* exposes an angular range wider than an angular interval between the local time markers provided on the location display disc 16, and thus, the multiple local time markers are exposed from the opening 3*c* simultaneously. In the side of the rotation axis of the hands 11-13 from the opening 3*c*, a pointer 3*d* is provided for indicating one of the local time markers (exposed at a predetermined position), here, a laterally-oriented triangle whose inside is filled, and when one of the local time markers is at a position that matches the pointer, about two local time markers are exposed at each of upper and lower (front and rear) parts of the one of the local time markers, from the opening 3*c*.

The markers "TIME," "T+P" respectively indicate that only the date and time information is computed, and that both the date and time and the current location are computed, when the radio wave is received from the positioning satellite by the satellite radio wave reception processing unit 49.

The bezel 4*a* is provided with time difference markers indicating time differences (+14 to −12), instead of the local time markers.

Figure 11:
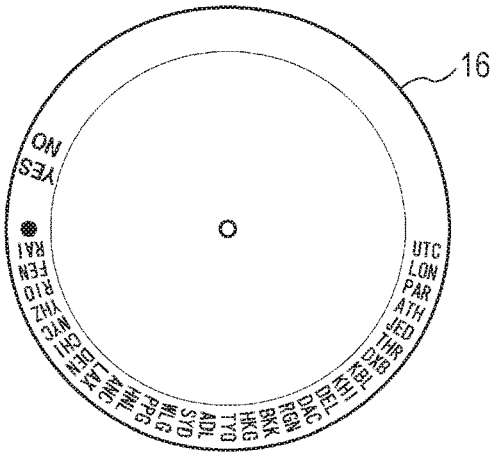
FIG. 11 is a front view of a location display disc.

FIG. 11 is a front view of the location display disc 16.

As for the local time markers, here, similarly to the electronic timepiece 1 of the first embodiment, a total of 30 markers including location markers indicating 28 cities or regions, a reference marker indicating UTC, and an exception marker, are arranged at equal intervals of 4 degrees within the range of 120 degrees; however, not limited to this, more local time markers may be provided for indicating the time zones (cities or regions).

In addition, on the location display disc 16, markers "YES," "NO" are provided apart from the local time markers. These two markers indicate computation success/failure of the location information by the satellite radio wave reception processing unit 49.

With these configurations, in the electronic timepiece 1*a* of the present embodiment, the location display disc 16 configures an indicator, and the dial 3 (pointer 3*d*) configures an indication part.

Figure 12:
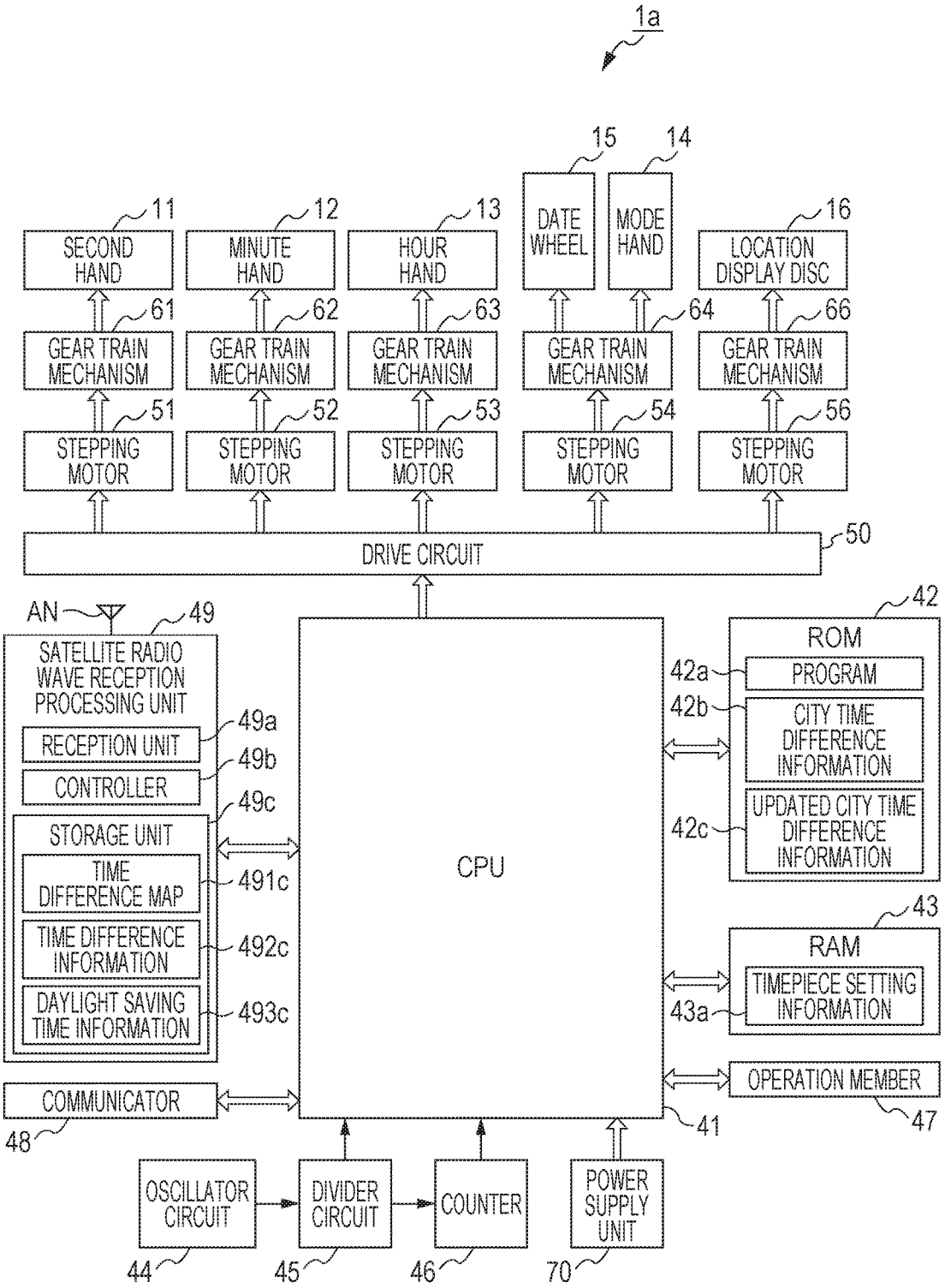
FIG. 12 is a block diagram illustrating a functional configuration of the electronic timepiece of the second embodiment.

FIG. 12 is a block diagram illustrating a functional configuration of the electronic timepiece 1*a* of the present embodiment.

The function configuration is the same as that of the electronic timepiece 1 of the first embodiment except that the location display disc 16, a stepping motor 56, a gear train mechanism 66, and the like are added, and descriptions will be omitted for the same components.

As for the location display disc 16, for example, 60 steps of rotational operation cause 4 degrees of rotation, and the local time marker exposed from the opening 3*a* changes by 1 city. That is, in accordance with rotational operation (180 degrees of rotation) of the stepping motor 56, the gear train mechanism 66 rotates the location display disc 16 by 1/15 degrees.

Figure 13:
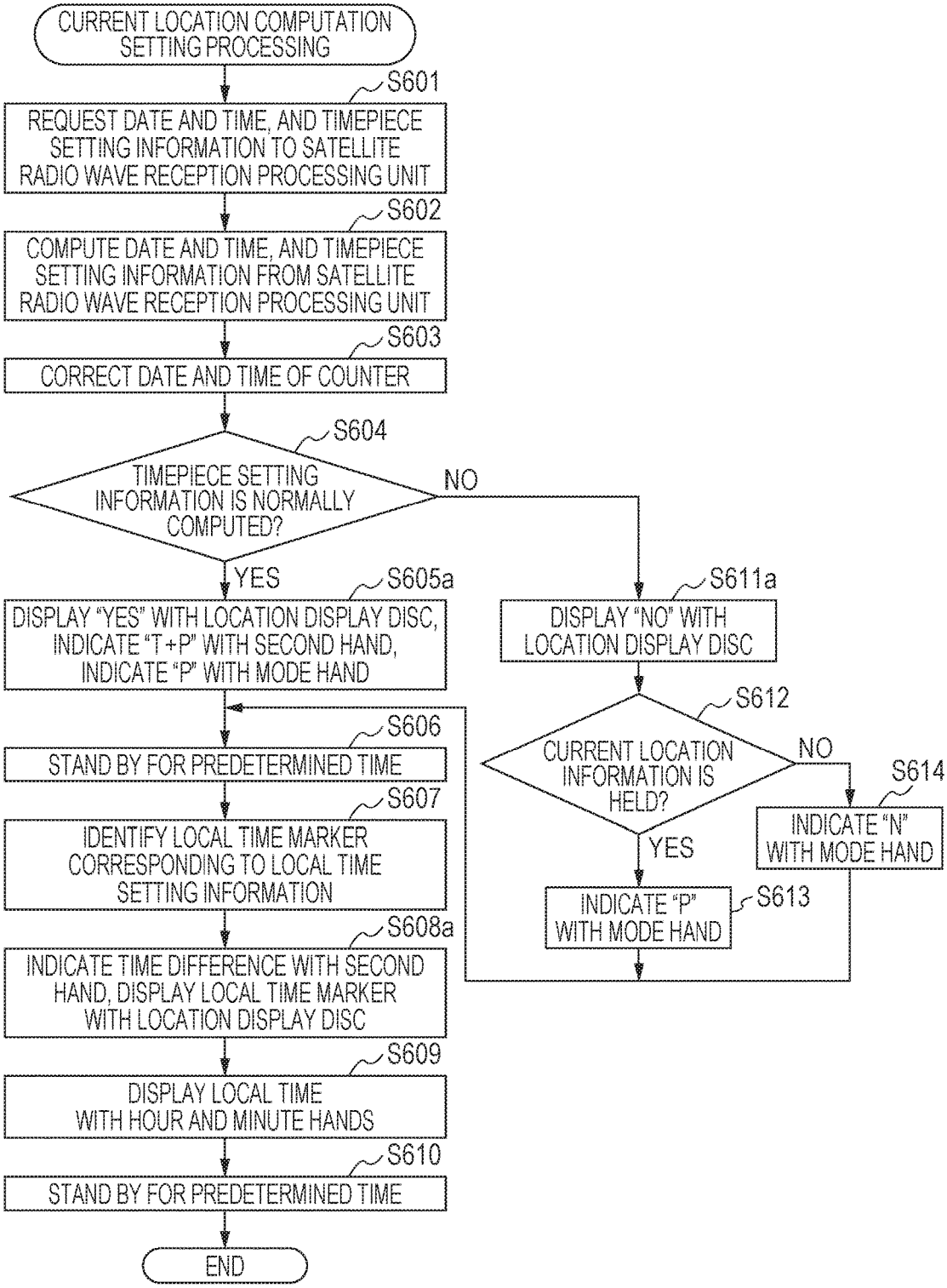
FIG. 13 is a flowchart illustrating a control procedure of current location computation setting processing executed in the electronic timepiece of the second embodiment.

FIG. 13 is a flowchart illustrating a control procedure by the CPU 41 of current location computation setting processing executed in the electronic timepiece 1*a* of the present embodiment.

This current location computation setting processing is the same as the current location computation setting processing of the first embodiment except that the processings in steps S605, S608, S611 are respectively replaced by processings in steps S605*a*, S608*a*, S6011*a*, and the same processing contents are denoted by the same reference numerals and detailed descriptions thereof are omitted.

When it is determined that the timepiece setting information is normally computed in the determination processing in step S604 ("YES" in step S604), the CPU 41 outputs a control signal to the drive circuit 50, and aligns the marker "YES" of the location display disc 16 with the position of the indication part 3*d* to display the marker, and causes the second hand 11 to indicate the marker "T+P," and causes the mode hand 14 to indicate the marker "P" (step S605*a*). Then, the processing of the CPU 41 proceeds to step S606.

In addition, when it is determined that the timepiece setting information is not normally computed in the determination processing in step S604 ("NO" in step S604), the CPU 41 outputs a control signal to the drive circuit 50, and aligns the marker "NO" of the location display disc 16 with the position of the indication part 3*d* to display the marker (step S611*a*). At this time, when only the date and time information is computed though the timepiece setting information is not computed, the CPU 41 causes the second hand 11 to indicate the marker "TIME." When the date and time information is also not computed, the CPU 41 causes the second hand 11 to move to a reference position, for example, the position of zero seconds. Then, the processing of the CPU 41 proceeds to step S612.

When the local time marker corresponding to the local time setting information is identified in the processing in step S607, the CPU 41 outputs a control signal to the drive circuit 50, causes the second hand 11 to indicate the time difference defined by the local time setting information, and causes the location display disc 16 to rotate so that the identified local time marker is aligned with the position of the indication part 3*d* (step S608*a*). Then, the processing of the CPU 41 proceeds to step S609.

FIG. 14 is a flowchart illustrating a control procedure by the CPU 41 of local time manual setting processing executed in the electronic timepiece 1*a* of the present embodiment.

This local time manual setting processing is the same as the local time manual setting processing by the electronic timepiece 1 of the first embodiment except that processings in the steps S502, S504, S513 are respectively replaced by those in steps S502*a*, S504*a*, S513*a*, and the same processing contents are denoted by the same reference numerals and descriptions thereof are omitted.

When it is determined that the crown C1 is in the first stage pull-out state in the determination processing in step S501 ("YES" in step S501), the CPU 41 outputs a control signal to the drive circuit 50, causes the hour and minute hands 12, 13 to display the local time on the basis of the timepiece setting information relating to the world timepiece, causes the location display disc 16 to rotate so that the local time marker corresponding to the time zone is aligned with the indication part 3*d*, and causes the second hand 11 to indicate the time difference (step S502*a*). Then, the processing of the CPU 41 proceeds to step S503.

When it is determined that the crown C1 is not in the first stage pull-out state (is in the second stage pull-out state) in the determination processing in step S501 ("NO" in step S501), the CPU 41 outputs a control signal to the drive circuit 50, causes the hour and minute hands 12, 13 to display the local time on the basis of the timepiece setting information relating to the basic timepiece, causes the location display disc 16 to rotate so that the local time marker corresponding to the time zone is aligned with the indication part 3*d*, and causes the second hand 11 to indicate the time difference (step S504*a*). Then, the processing of the CPU 41 proceeds to step S505.

In addition, when the processing proceeds from step S511 or step S512 to step S513*a*, the CPU 41 outputs a control signal to the drive circuit 50, and causes the location display disc 16 to rotate so that the neighboring local time marker is aligned with the indication part 3*d* regarding the direction corresponding to the direction of the detected crown C1 rotational operation. In addition, the CPU 41 outputs a control signal to the drive circuit 50 to cause the second hand 11 to indicate the time difference corresponding to the local time marker to be aligned with the position of the indication part 3*d*, and causes the hour and minute hands 12, 13 to display the local time reflecting the time difference (step S513*a*). Then, the processing of the CPU 41 returns to step S508.

Figure 15:
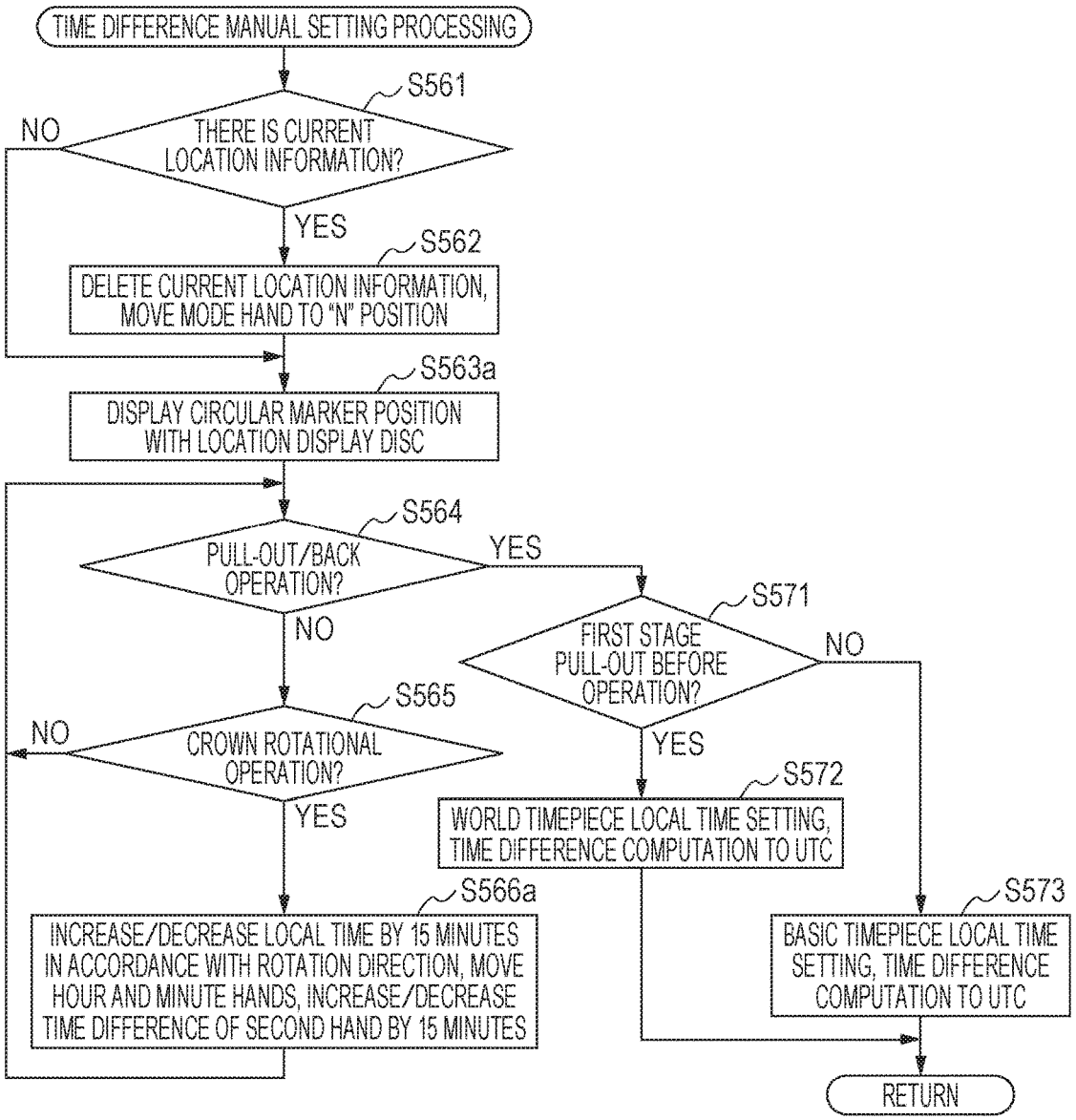
FIG. 15 is a flowchart illustrating a control procedure of time difference manual setting processing called in the local time manual setting processing of the electronic timepiece of the second embodiment.

FIG. 15 is a flowchart illustrating a control procedure by the CPU 41 of time difference manual setting processing called in the local time manual setting processing of the electronic timepiece 1*a* of the present embodiment.

This time difference manual setting processing is the same as the time difference manual setting processing called in the local time manual setting processing of the electronic timepiece 1 of the first embodiment except that the processings in steps S563, S566 are respectively replaced by processings in steps S563*a*, S566*a*, and the same processing contents are denoted by the same reference numerals and descriptions thereof are omitted.

When the processing proceeds from step S561 or step S562 to step S563*a*, the CPU 41 outputs a control signal to the drive circuit 50 to cause the location display disc 16 to rotate, so that the exception marker is aligned with the position of the indication part 3*d* (step S563*a*). Then, the processing of the CPU 41 proceeds to step S564.

When it is determined that the crown C1 rotational operation is detected in the determination processing in step S565 ("YES" in step S565), the CPU 41 changes the local time by 15 minutes in a direction according to the detected crown C1 rotation direction, and in accordance with this, changes the time difference by 15 minutes. Then, the CPU 41 outputs a control signal to the drive circuit 50, causes the hour and minute hands 12, 13 to display the changed local time, and causes the second hand 11 to display the changed time difference (step S566*a*). Then, the processing of the CPU 41 returns to step S564.

Figure 16A:
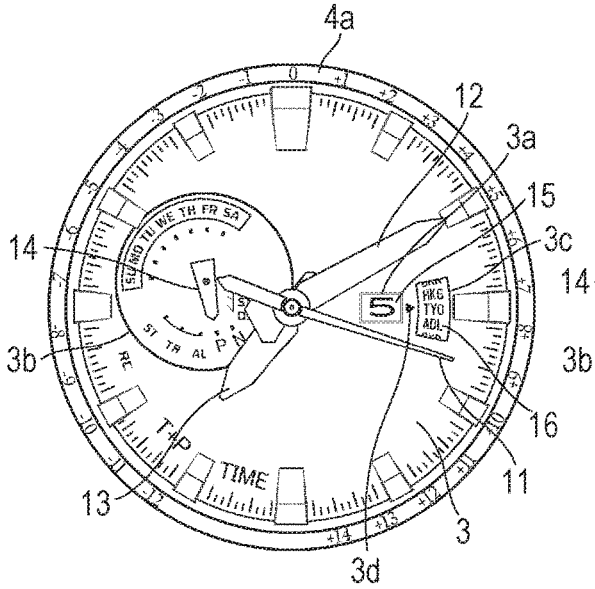
FIG. 16A is a diagram illustrating a display example at the time of local time setting in the electronic timepiece of the second embodiment.
Figure 16B:
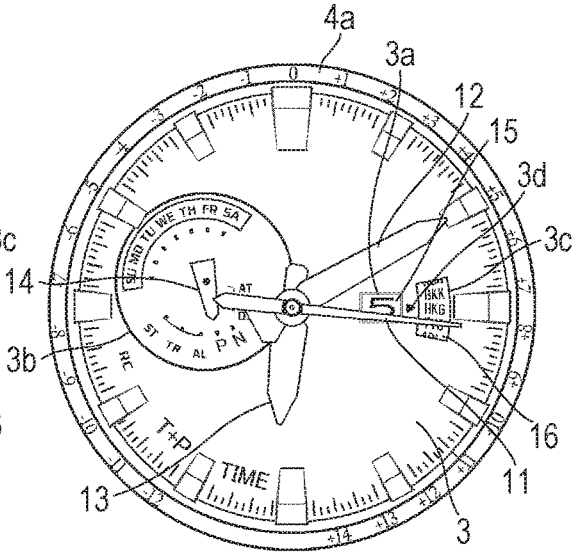
FIG. 16B is a diagram illustrating a display example at the time of local time setting in the electronic timepiece of the second embodiment.
Figure 16C:
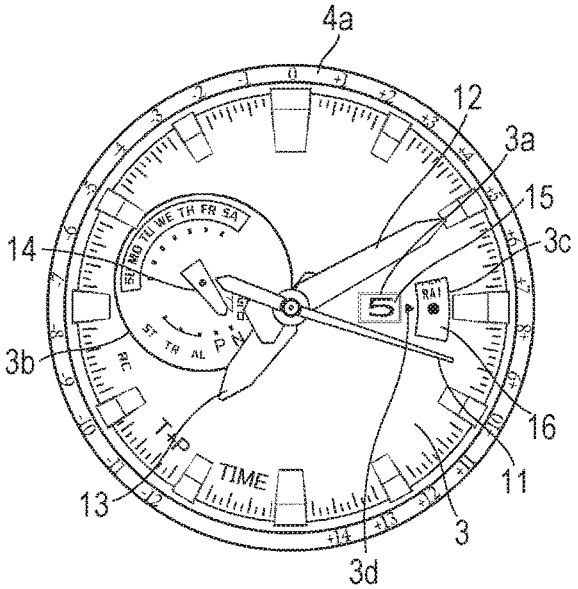
FIG. 16C is a diagram illustrating a display example at the time of local time setting in the electronic timepiece of the second embodiment.

FIGS. 16A to 16C are diagrams each illustrating a display example at the time of local time setting in the electronic timepiece 1*a* of the present embodiment.

When it is set to a time zone of UTC+9 hours such as Tokyo or Jayapura in Indonesia on the basis of the city time difference information 42*b* illustrated in FIG. 3A by radio wave reception from the positioning satellite at 10:10 UTC, the local time is 19:10, and the hour and minute hands 12, 13 indicate 7:10 as illustrated in FIG. 16A. In addition, the mode hand 14 indicates the marker "P," the second hand 11 indicates the marker "+9" corresponding to UTC+9, and the location display disc 16 is rotated so that the local time marker "TYO" is aligned with the indication part 3*d*.

When the updated city time difference information 42*c* illustrated in FIG. 3B is computed and then radio wave reception is performed in Tokyo, the time difference in Tokyo has been changed to +8 hours, so that the local time is 18:10, and the hour and minute hands 12, 13 indicate 6:10, as illustrated in FIG. 16B. In addition, the mode hand 14 indicates the marker "P," the second hand 11 indicates the marker "+8" corresponding to UTC+8, and the location display disc 16 is rotated so that the local time marker "HKG" is aligned with the indication part 3*d*.

When the updated city time difference information 42*c* illustrated in FIG. 3B is computed and then the user manually sets the time difference in Jayapura in which the time difference is UTC+9 hours, there is no local time marker corresponding to UTC+9 on the location display disc 16. Therefore, setting is performed such that the date and time is advanced by one hour from UTC+8 by the time difference manual setting processing. As a result, as illustrated in FIG. 16C, the hour and minute hands 12, 13 indicate 7:10 correspondingly to 19:10. In addition, the mode hand 14 indicates the marker "N," the second hand 11 indicates the marker "+9" corresponding to UTC+9, and the location display disc 16 is rotated so that the exception marker is aligned with the indication part 3*d*.

As described above, in the electronic timepiece 1*a* of the second embodiment, the indication part is the dial 3 having the opening 3*c* provided on the location display disc 16 (in particular, indication part 3*d*), and the location display disc 16 is provided to be capable of rotation, and one of the local time markers provided on the location display disc 16 can be selectively exposed from a predetermined position of the opening 3*c*, and the CPU 41 causes the location display disc 16 to rotate to expose one of the local time markers from the predetermined position of the opening 3*c*, whereby it is indicated that the one of local time markers is selected.

In this way, even in a configuration in which the local time marker is moved, it is possible to perform display relating to the time zone flexibly and appropriately in the electronic timepiece 1*a*, similarly to the electronic timepiece 1 of the first embodiment described above.

Incidentally, the present invention is not limited to the above embodiments, and can be variously modified.

For example, one exception marker is provided in the above embodiment; however, it does not exclude a case in which a plurality of exception markers is arranged. However, the plurality of exception markers to be provided is not provided in association with a particular time zone. In addition, the exception marker to be provided in the exception indication position is not limited to the shape and the like illustrated in the above embodiments. The exception marker may be a character marker, or there may be provided with only a space simply and no marker.

In addition, in the above embodiments, the local time markers are provided respectively in association with different time zones, in the initial state; however, it is not limited thereto. The local time markers may be provided each corresponding to a plurality of cities or regions in the same time zone, depending on a difference in the daylight saving time implementation rule or the like.

In addition, in the above embodiments, the description has been made in a case in which the daylight saving time is not considered during local time (time zone) setting; however, the time zone setting may be performed similarly on the basis of the local time in which the daylight saving time is implemented. In particular, when the current time is specified and the time zone is defined on the basis of the difference from the UTC date and time, the time difference reflecting the daylight saving time implementation presence/absence may be considered by switching the display of daylight saving time implementation presence/absence with the mode hand 14.

In addition, in the above embodiment, communication connection with the external device is performed by using Bluetooth and the updated data is received; however, wired connection may be used using a USB cable or the like, and data reception may be performed via a detachable storage medium such as a microSD card. In addition, the present invention can be applied to an electronic timepiece that is not capable of performing such data exchange.

In addition, in the above embodiment, the current location is computed by receiving the radio wave from the positioning satellite; however, the current location information may be computed via other communication radio waves and the like, and an electronic timepiece may be used to which the current location can only be set manually by the user. In addition, an electronic timepiece may be used including a configuration capable of specifically displaying the computed current location with latitude and longitude.

In addition, in the above embodiments, the description has been made for the analog type electronic timepiece using hands and rotating disc for all indicators, as an example; however, as far as it is an electronic timepiece having an analog configuration in which an indicator including local time markers and a hand or indication part selectively indicating any of the local time markers move relative to each other, an electronic timepiece may be used in which part of the display is made by a configuration not having a movable part, such as a digital display screen or lighting operation. In addition, the indicator, and the hand or indication part may be all movable.

In addition, the control operation as the controller is performed by the CPU 41 all by software; however, part of the control operation may be performed by a dedicated hardware circuit and the like.

Some embodiments of the present invention have been described; however, the scope of the present invention is not limited to the above embodiments, and includes the scope of the invention described in the claims and the scope of equivalents thereof.

What is claimed is:

1. An electronic timepiece comprising:

an indicator on which a plurality of location markers is provided for indicating locations in various places of the world;

a hand that moves relative to the indicator;

a memory that stores time difference information in which each of the location markers and information relating to a time zone to which a location indicated by each of the location markers belongs are associated with each other;

a controller that performs operation control for moving the hand and the indicator relative to each other; and an operation member that accepts an input operation, wherein:

the indicator has an exception indication position representing non-correspondence to any time zone associated with each of the location markers by being in a predetermined positional relationship with the hand, the controller causes the hand and the exception indication position to be in the predetermined positional relationship when none of the location markers are associated with a set time zone, during display relating to the set time zone for a date and time to be displayed, and when a rotational operation of the operation member is detected which indicates that a relative positional relationship between the hand and each of the location markers should be incrementally changed in a certain direction and none of the location markers are associated with the set time zone, (i) the controller incrementally changes the relative positional relationship between each of the location markers and the hand according to the rotational operation by a single predetermined increment in the certain direction indicated by the rotational operation, in a case in which the hand is in the predetermined positional relationship with one of the location markers which is immediately followed by a next one of the location markers in the certain direction, such that the incremental change by the single predetermined increment causes the hand and the next one of the location markers to be in the predetermined positional relationship, and (ii) the controller incrementally changes the relative positional relationship between each of the location markers and the hand according to the rotational operation by an increment larger than the single predetermined increment in the certain direction indicated by the rotational operation, in a case in which the hand is in the predetermined positional relationship with one of the location markers which is immediately followed by the exception indication position in the certain direction indicated by the rotational operation so as to skip over the exception indication position such that the hand and the exception indication position are not brought into the predetermined positional relationship with each other by the incremental change and so that the hand is brought into the predetermined positional relationship with a next location marker which follows the exception indication position in the certain direction indicated by the rotational operation.

2. The electronic timepiece according to claim 1, wherein the memory is capable of updating and storing the time difference information.

3. The electronic timepiece according to claim 2, wherein the controller determines whether or not a time zone associated with each of the location markers has been changed from an initial setting and, when the time zone associated with each of the location markers has been changed from the initial setting, does not perform operation control that causes each of the location markers and the hand to be in the predetermined positional relationship, during display relating to the set time zone.

4. The electronic timepiece according to claim 3, further comprising a communicator that receives the time difference information to be updated and stored from an external device.

5. The electronic timepiece according to claim 2, further comprising a communicator that receives the time difference information to be updated and stored from an external device.

6. The electronic timepiece according to claim 2, wherein the controller performs time zone setting for a date and time to be displayed, based on !predetermined input operation, and performs display relating to the time zone by causing the hand and the exception indication position to be in the predetermined positional relationship when a set time zone does not correspond to any of the location markers.

7. The electronic timepiece according to claim 1, wherein a predetermined marker is provided at the exception indication position.

8. The electronic timepiece according to claim 1, wherein the controller performs time zone setting for a date and time to be displayed, based on p predetermined input operation, and performs display relating to the time zone by causing the hand and the exception indication position to be in the predetermined positional relationship when a set time zone does not correspond to any of the location markers.

9. The electronic timepiece according to claim 8, further comprising a counter that counts a date and time to be a reference, wherein the controller performs the time zone setting, based on a difference between a current date and time accepted via the predetermined input operation and the date and time to be the reference.

10. The electronic timepiece according to claim 9, wherein the controller changes a relative positional relationship between each of the location markers and the hand, based on a first input operation, and displays a date and time in a time zone associated with each of the location markers having the predetermined positional relationship with the hand with the changed relative positional relationship, as the date and time to be displayed, and changes the displayed date and time, based on a second input operation, and sets the time zone, based on a difference between the changed date and time and the date and time to be the reference.

11. The electronic timepiece according to claim 1, further comprising a positioning device that computes a current location, wherein the positioning device stores a correspondence relationship between the computed current location and the time zone, and the controller reads the correspondence relationship from the positioning device, and identifies a time zone to which the current location computed by the positioning device belongs, based on the read correspondence relationship.

12. The electronic timepiece according to claim 11, wherein the positioning device is capable of updating and storing the correspondence relationship.

13. The electronic timepiece according to claim 11, further comprising a mode hand, wherein information relating to the current location is computed by the positioning device, and the mode hand indicates whether or not a time zone corresponding to the current location is used for setting of the date and time to be displayed.

14. The electronic timepiece according to claim 11, wherein the positioning device includes a receiver for performing positioning by receiving a radio wave from a positioning satellite.

15. The electronic timepiece according to claim 1, further comprising a positioning device that computes a current location, wherein the memory stores a correspondence relationship between the current location computed by the positioning device and the time zone, and the controller reads the correspondence relationship from the memory, and identifies a time zone to which the current location computed by the positioning device belongs, based on the read correspondence relationship.

16. The electronic timepiece according to claim 15, wherein the memory is capable of updating and storing the correspondence relationship.

17. The electronic timepiece according to claim 15, wherein a time difference information storage unit is capable of updating and storing the correspondence relationship.

18. The electronic timepiece according to claim 15, further comprising a mode hand, wherein information relating to the current location is computed by the positioning device, and the mode hand indicates whether or not a time zone corresponding to the current location is used for setting of the date and time to be displayed.

19. The electronic timepiece according to claim 15, wherein the positioning device includes a receiver for performing positioning by receiving a radio wave from a positioning satellite.

20. A display method for a date and time to be displayed in an electronic timepiece comprising: an indicator on which a plurality of location markers is provided for indicating locations in various places of the world; a hand that moves relative to the indicator and indicates predetermined information by a positional relationship with each of the location markers; a memory that stores time difference information in which each of the location markers and information relating to a time zone to which a location indicated by each of the location markers belongs are associated with each other; and an operation member that accepts an input operation, the display method comprising:

setting in the indicator an exception indication position representing non-correspondence to any time zone associated with each of the location markers by being in a predetermined positional relationship with the hand;

moving the hand and the indicator relative to each other, and causing the hand and the exception indication position to be in the predetermined positional relationship when none of the location markers are associated with a set time zone, during display relating to the set time zone for a date and time to be displayed; and when a rotational operation of the operation member is detected which indicates that a relative positional relationship between the hand and each of the location markers should be incrementally changed in a certain direction and none of the location markers are associated with the set time zone, (i) incrementally changing the relative positional relationship between each of the location markers and the hand according to the rotational operation by a single predetermined increment in the certain direction indicated by the rotational operation, in a case in which the hand is in the predetermined positional relationship with one of the location markers which is immediately followed by a next one of the location markers in the certain direction, such that the incremental change by the single predetermined increment causes the hand and the next one of the location markers to be in the predetermined positional relationship, and (ii) incrementally changing the relative positional relationship between each of the location markers and the hand according to the rotational operation by an increment larger than the single predetermined increment in the certain direction indicated by the rotational operation, in a case in which the hand is in the predetermined positional relationship with one of the location markers which is immediately followed by the exception indication position in the certain direction indicated by the rotational operation so as to skip over the exception indication position such that the hand and the exception indication position are not brought into the predetermined positional relationship with each other by the incremental change and so that the hand is brought into the predetermined positional relationship with a next location marker which follows the exception indication position in the certain direction indicated by the rotational operation.

* * * * *